US005979413A

United States Patent [19]

Ohnuma et al.

[11] Patent Number: 5,979,413

[45] Date of Patent: Nov. 9, 1999

[54] CYLINDER JUDGING DEVICE FOR INTERNAL COMBUSTION ENGINE

[75] Inventors: Mitsuhiko Ohnuma; Yasuki Tamura; Shougo Ohmori; Tsuyoshi Tadanaga, all of Tokyo, Japan

[73] Assignee: Mitsubishi Jidosha Kogyo Kabushiki Kaisha, Tokyo, Japan

[21] Appl. No.: 08/945,648

[22] PCT Filed: Feb. 28, 1997

[86] PCT No.: PCT/JP97/00617

§ 371 Date: Oct. 31, 1997

§ 102(e) Date: Oct. 31, 1997

[87] PCT Pub. No.: WO97/32123

PCT Pub. Date: Sep. 4, 1997

[30] Foreign Application Priority Data

Mar. 1, 1996 [JP] Japan ..... 8-045079

[51] Int. Cl.[6] ..... F02P 5/04

[52] U.S. Cl. ..... 123/491; 123/406.58; 73/116

[58] Field of Search ..... 123/406.58, 52.3, 123/52.1, 54.3, 50 R, 491; 73/116

[56] References Cited

U.S. PATENT DOCUMENTS 4,515,131 5/1985 Suzuki et al. ..... 123/406.58

5,067,462 11/1991 Iwata et al. ..... 73/116

5,452,604 9/1995 Namiki et al. ..... 123/491

5,522,256 6/1996 Hashimoto et al. ..... 73/116

*Primary Examiner*—Tony M. Argenbright

*Assistant Examiner*—Mahmoud M. Gimie

[57] ABSTRACT

A rotating member is provided on an output rotating shaft of an internal combustion engine to generate a signal corresponding to a predetermined cylinder group and an identification signal for identifying the particular cylinder group, and based on these signals, the particular cylinder group is identified. At the time of the start of internal combustion engine, fuel cut mode, or steady constant-speed running, the fuel injection amount of the particular cylinder among said particular cylinder groups is made different from that of other cylinders at a group injection timing such that the particular cylinder assumed on the basis of the cylinder group identification result is the reference, whether the assumption is true or false is judged from the present rotational variation and the cylinder group identification result, and the stroke phase of each cylinder is discriminated to make cylinder discrimination. At this time, the controlled variable relating to the rotational speed is regulated for other cylinders.

12 Claims, 17 Drawing Sheets

FIG. 5

| | | | | | | | | |
|---|---|---|---|---|---|---|---|---|
| #1 | EX | IN | CP | CB | EX | IN | CP | CB |
| #3 | CB | EX | IN | CP | CB | EX | IN | CP |
| #4 | CP | CB | EX | IN | CP | CB | EX | IN |
| #2 | IN | CP | CB | EX | IN | CP | CB | EX |

FIG. 6

| | | | | | | | | |
|---|---|---|---|---|---|---|---|---|
| #1 | EX | IN | CP | CB | EX | IN | CP | CB |
| #3 | CB | EX | IN | CP | CB | EX | IN | CP |
| #4 | CP | CB | EX | IN | CP | CB | EX | IN |
| #2 | IN | CP | CB | EX | IN | CP | CB | EX |

FIG. 7

| | | | | | | | | |
|---|---|---|---|---|---|---|---|---|
| #1 | EX | IN | CP | CB | EX | IN | CP | CB |
| #3 | CB | EX | IN | CP | CB | EX | IN | CP |
| #4 | CP | CB | EX | IN | CP | CB | EX | IN |
| #2 | IN | CP | CB | EX | IN | CP | CB | EX |

FIG. 18

| | | | | | | | | |
|---|---|---|---|---|---|---|---|---|
| #1 | EX | IN | CP | CB | EX | IN | CP | CB |
| #3 | CB | EX | IN | CP | CB | EX | IN | CP |
| #4 | CP | CB | EX | IN | CP | CB | EX | IN |
| #2 | IN | CP | CB | EX | IN | CP | CB | EX |

FIG. 19

| | | | | | | | | |
|---|---|---|---|---|---|---|---|---|
| #1 | EX | IN | CP | CB | EX | IN | CP | CB |
| #3 | CB | EX | IN | CP | CB | EX | IN | CP |
| #4 | CP | CB | EX | IN | CP | CB | EX | IN |
| #2 | IN | CP | CB | EX | IN | CP | CB | EX |

FIG. 20

| | | | | | | | | |
|---|---|---|---|---|---|---|---|---|
| #1 | EX | IN | CP | CB | EX | IN | CP | CB |
| #3 | CB | EX | IN | CP | CB | EX | IN | CP |
| #4 | CP | CB | EX | IN | CP | CB | EX | IN |
| #2 | IN | CP | CB | EX | IN | CP | CB | EX |

FIG. 22A

LOWER LIMIT FLOW RATE OF INTAKE AIR AMOUNT IN CYLINDER DISCRIMINATION

| ROTATIONAL SPEED | 500 | 750 | 1000 | ~ | 3000 | 4000 |
|---|---|---|---|---|---|---|
| TSIKIB | LOW ← | | | | → HIGH | |

FIG. 22B

WATER TEMPERATURE CORRECTION FACTOR FOR INTAKE AIR FLOW RATE IN CYLINDER DISCRIMINATION

| WATER TEMPERATURE | −32 | −8 | 7 | ~ | 77 | 82 |
|---|---|---|---|---|---|---|
| KQWT | HIGH ← | | | | → LOW | |

FIG. 23A

WATER TEMPERATURE CORRECTION FACTOR FOR ACCELERATION INCREASE AMOUNT

| WATER TEMPERATURE | −32 | −8 | 7 | ~ | 77 | 82 |
|---|---|---|---|---|---|---|
| TKQWT | HIGH ← | | | | → LOW | |

FIG. 23B

ROTATIONAL SPEED CORRECTION FACTOR FOR ACCELERATION INCREASE AMOUNT

| ROTATIONAL SPEED | 500 | 750 | 1000 | ~ | 3000 | 5000 |
|---|---|---|---|---|---|---|
| TKANE | LOW ← | | | | → HIGH | |

FIG. 23C

TAILING FACTOR FOR ACCELERATION INCREASE AMOUNT

| WATER TEMPERATURE | −32 | −8 | 7 | ~ | 77 | 82 |
|---|---|---|---|---|---|---|
| TKATL | HIGH ← | | | | → LOW | |

FIG. 24A

WATER TEMPERATURE CORRECTION FACTOR FOR DECELERATION DECREASE AMOUNT

| WATER TEMPERATURE | −32 | −8 | 7 | ~ | 77 | 82 |
|---|---|---|---|---|---|---|
| TGENWT | HIGH ← | | | | → LOW | |

FIG. 24B

ROTATIONAL SPEED CORRECTION FACTOR FOR DECELERATION DECREASE AMOUNT

| ROTATIONAL SPEED | 500 | 750 | 1000 | ~ | 3000 | 4000 |
|---|---|---|---|---|---|---|
| TGENNE | LOW ← | | | | → HIGH | |

FIG. 24C

PRESSURE CORRECTION FACTOR FOR DECELERATION DECREASE AMOUNT

| PRESSURE | 60 | 160 | 260 | ~ | 660 | 760 |
|---|---|---|---|---|---|---|
| TGENPR | LOW ← | | | | → HIGH | |

FIG. 24D

TAILING FACTOR FOR DECELERATION DECREASE AMOUNT

| WATER TEMPERATURE | −32 | −8 | 7 | ~ | 77 | 82 |
|---|---|---|---|---|---|---|
| TKDTLS | HIGH ← | | | | → LOW | |

FIG. 25A

WATER TEMPERATURE CORRECTION FACTOR FOR ASYNCHRONOUS INJECTION AMOUNT

| WATER TEMPERATURE | −32 | −8 | 7 | ~ | 77 | 82 |
|---|---|---|---|---|---|---|
| TRNJWT | HIGH ← | | | | → LOW | |

FIG. 25B

ROTATIONAL SPEED CORRECTION FACTOR FOR ASYNCHRONOUS INJECTION AMOUNT

| ROTATIONAL SPEED | 500 | 750 | 1000 | ~ | 3000 | 4000 |
|---|---|---|---|---|---|---|
| TRNJNE | LOW ← | | | | → HIGH | |

FIG. 25C

BASE INJECTION AMOUNT FOR ASYNCHRONOUS INJECTION

| THROTTLE OPENING | 0 | 1.6 | 3.1 | ~ | 10.9 | 12.5 |
|---|---|---|---|---|---|---|
| TRNJQ | LOW ← | | | | → HIGH | |

CYLINDER JUDGING DEVICE FOR INTERNAL COMBUSTION ENGINE

TECHNICAL FIELD

The present invention relates to a cylinder discriminating apparatus for an internal combustion engine, for reliably identifying, with a simple implementation, the stroke phase of each cylinder in a multiple cylinder type internal combustion engine with the internal combustion engine not being stopped.

BACKGROUND ART

In a multiple cylinder type internal combustion engine, which has a plurality of cylinders, the use of a so-called multi-point injection (MPI) system, in which an injector for fuel injection is arranged for each cylinder, is generally know. An MPI system provides a high degree of freedom of air intake system, and easily achieves a high output. For this reason, the MPI system attracts attention as a main system for electronic controlled fuel injection.

An MPI system uses a group injection method in which a plurality of cylinders are grouped in advance and the injectors for each cylinder group are operated simultaneously to inject fuel, or a sequential injection method in which a plurality of injectors are operated independently to sequentially inject fuel into each cylinder. Whichever fuel injection method may be used, it is desirable to set the fuel injection timing so as to avoid a stroke having the possibility of deteriorated combustion and deteriorated exhaust gas, and, more particularly, the intake stroke.

In order to set the fuel injection timing for each cylinder or each cylinder group so as to avoid the above mentioned problem of the intake stroke, it is important to determine in which stroke of the combustion cycle each cylinder of internal combustion engine is in. Specifically, a combustion cycle consisting of four strokes of intake, compression, combustion (expansion), and exhaust is repeated in each cylinder of internal combustion engine. For each cylinder, moreover, the timing is set in advance to enter the combustion stroke sequentially at equal intervals. Therefore, if it can be determined in which stroke the particular cylinder is, or inversely which cylinder is in the particular stroke, it can be known in which stroke each of the remaining cylinders is.

The fuel injection described above before is controlled on the basis of such a cylinder discrimination result. At the start of the internal combustion engine, there scarcely arises a problem even if fuel is simultaneously injected into plural cylinders, so that, generally, it is necessary only that the cylinder discrimination is made after cranking is completed.

However, the requirement for cylinder discrimination necessary to control the ignition system is very severe as compared with the cylinder discrimination necessary to control the fuel injection. Incidentally, a high voltage distribution system, which ignites cylinders in sequence by distributor, presents no problem because the cylinder operated by ignition is automatically selected by the distributor. For a low voltage distribution system, which does not use a distributor, it is necessary to make cylinder discrimination as quickly as possible at the engine start so as to determine which ignition coil (cylinder) should be energized.

Conventionally, in order to control the ignition and fuel injection timing for each cylinder, and further to detect the rotational speed, a sensor is mounted on the rotating output shaft (crankshaft) of the internal combustion engine to detect the crank angle. Since the crankshaft rotates two turns in one combustion cycle, however, cylinder cannot be identified directly from the output of the crank angle sensor. A cylinder group consisting of two cylinders with a 360° mutually different stroke phase can be identified from the output of the crank angle sensor, though. Conventionally, therefore, a sensor is also mounted on a camshaft rotating in connection with the crankshaft to determine a 360° difference in stroke phase. Thus, the cylinder can be discriminated by using the signal from the cam sensor and that from the crank angle sensor. The camshaft, which opens and closes the intake and exhaust valves for each cylinder in the valve train, rotates one turn in synchronization with two turns of the crankshaft.

However, if the cylinder discrimination is implemented by two signal systems consisting of the crank angle sensor and the cam sensor, the construction is generally becomes complicated and the cost is increased. Moreover, variations in phase inevitably occur between the signals obtained from the sensors due to the extension/contraction, deflection, etc. of a timing belt for connecting the crankshaft with the camshaft. For this reason, there are possibilities of a cylinder discrimination timing lag and mistaken discrimination.

Unexamined Japanese Patent Publication No. 6-213052 discloses a special sensor that is mounted on the crankshaft to generate a preset reference angle signal and a rotating angle signal. According to this Publication, a method is disclosed in which based on the signal obtained from this sensor, a control signal for each crank angle of 360° with the detection timing of the reference angle signal being the reference is obtained, and the group injection of fuel and group ignition for the plural cylinders are effected according to the control signal.

This Publication also discloses the technology in which by stopping the fuel injection to one particular cylinder in the group injection/ignition mode, that cylinder is made to misfire intentionally, and a cylinder discrimination is made by determining whether or not the misfire is detected. Further, this Publication discloses a method in which the mode is switched into an independent injection/ignition mode in which after the cylinder discrimination is completed, fuel is injected independently to each cylinder for each crank angle of 720° according to the cylinder discrimination result.

With the method disclosed in this Publication, however, in order to make one particular cylinder misfire, the stopping of fuel injection to that cylinder must be repeated for each 360° CA (crank angle) throughout plural cycles based on the above-mentioned control signal. Moreover, the cylinder discrimination cannot be made until the particular cylinder is thus made to misfire and the misfire is detected. In addition, in order to increase the reliability of cylinder discrimination, the aforesaid interruption of fuel injection and detection of misfire caused by this must be repeated. Therefore, the misfire state continues for a relatively long period of time, which is undesirable for an internal combustion engine.

Also, with this conventional method, if a mistaken cylinder discrimination occurs at the engine start, the fuel injection control is carried out according to the mistaken cylinder determination result, and this state continues, so that a problem of deteriorated fuel consumption etc. arises. Further, the fuel injection is stopped compulsorily to cause misfire, by which rotational variation is produced. Therefore, there is a possibility of a problem arising in that the internal combustion engine stops when cylinder discrimination is made (engine stop).

The present invention was made in view of the above situation, and accordingly a first object thereof is to efficiently produce cylinder discrimination at the start of an internal combustion engine. Also, a second object is to produce cylinder discrimination reliably and accurately even at a time other than at engine start. Further, a third object is to improve the reliability of cylinder discrimination, and a fourth object is to prevent a problem such as engine stopping from occurring when cylinder discrimination is produced.

Still further, a fifth object of the present invention is to enable cylinder discrimination even when the internal combustion engine is running in a steady state, and a sixth object thereof is to prevent variations in the output of internal combustion engine when cylinder discrimination is produced.

The present invention provides a cylinder discriminating scheme for an internal combustion engine which can achieve the above mentioned objects.

DISCLOSURE OF THE INVENTION

A cylinder discriminating method and apparatus in accordance with the present invention is provided in a multiple cylinder type of internal combustion engine which includes a plurality of cylinders having one combustion stroke per two turns of a crankshaft, i.e. a combustion cyccle and entering the combustion stroke in sequence at equal intervals. The apparatus basically comprises cranking detecting means for detecting the cranking state of the internal combustion engine; injection control means for controlling the actuation of a fuel injection valve provided in each of the cylinders; rotational variation detecting means for detecting a rotational variation of the internal combustion engine; identifying means for generating a signal for identifying a particular cylinder of the internal combustion engine; and cylinder discriminating means for discriminating the stroke phase of a cylinder in accordance with the output of the identifying means and the rotational variation detecting means.

To achieve the above objects, in the cylinder discriminating apparatus in accordance with the present invention, the identifying means is configured as a sensing member which is provided on a rotating output shaft i.e., the crankshaft of the internal combustion engine and generates a signal corresponding to each cylinder or each cylinder group with a 360° different stroke phase of the internal combustion engine and an identification signal for identifying a single particular cylinder or two particular cylinders with a 360° different stroke phase in synchronization with the rotation of the rotating output shaft or crankshaft; and rotational variation imparting means is provided to produce a rotational variation to the internal combustion engine by controlling the operation of the injection control means when the cranking of the internal combustion engine is detected by the cranking detecting means.

In particular, the rotational variation imparting means stops the operation of the fuel injection valve for a single particular cylinder or particular cylinder and a cylinder entering the combustion stroke continuously with this particular cylinder, or makes the fuel injection amount from the fuel injection valve to these cylinders different from the fuel injection amount from the fuel injection valve to other cylinders, thereby positively imparting a rotational variation to the internal combustion engine when the internal combustion engine has odd-numbered cylinders, and stops the operation of the fuel injection valve for either one of the two particular cylinders with a 360° different stroke phase or either one of the two particular cylinders and a cylinder entering the combustion stroke continuously with this cylinder, or makes the fuel injection amount from the fuel injection valve to these cylinders different from the fuel injection amount from the fuel injection valve to other cylinders, thereby positively imparting a rotational variation to the internal combustion engine when the internal combustion engine has even-numbered cylinders.

According to the present invention, a rotational variation is imparted to the internal combustion engine by making the fuel injection amount for a particular cylinder (cylinder group) different from the fuel injection amount for other cylinders (cylinder groups) at the start of the internal combustion engine, and the stroke phase of cylinder is discriminated in accordance with the present rotational variation and the cylinder group identification result detected by the identifying means, by which cylinder discrimination can be made even when the particular cylinder (cylinder group) does not misfire, the time taken for the cylinder discrimination can be shortened, and the reliability of discrimination result can be enhanced.

Also, a cylinder discriminating apparatus in accordance with the present invention has controlled variable regulating means for regulating a controlled variable relating to the rotational speed of the internal combustion engine in order to keep the rotational speed at a predetermined speed or higher when the rotational variation imparting means is operated, for example, means for regulating the air amount at an idling time, by which the stopping of the internal combustion engine is prevented during cylinder discrimination.

Another cylinder discriminating apparatus in accordance with the present invention further has fuel cut judging means for judging a fuel cut zone in vehicle deceleration where fuel injection is cut by the injection control means, by which the rotational variation imparting means is operated when the fuel cut zone is judged by the fuel cut judging means.

In particular, in this case, when the internal combustion engine has odd-numbered cylinders, fuel corresponding to the fuel injection amount from the fuel injection valve for the single particular cylinder or the particular cylinder and a cylinder entering the combustion stroke continuously with this particular cylinder is injected by actuating the fuel injection valve, thereby positively producing a rotational variation to the internal combustion engine, and when the internal combustion engine has even-numbered cylinders, fuel corresponding to the fuel injection amount from the fuel injection valve for either one of the two particular cylinders with a 360° different stroke phase or either one of said two particular cylinders and a cylinder entering the combustion stroke continuously with this cylinder is injected by actuating the fuel injection valve, hereby positively producing a rotational variation to the internal combustion engine.

That is to say, in the fuel cut mode of the internal combustion engine, the fuel injection amount for the particular cylinder (cylinder group) is made different from the fuel injection amount for other cylinders (cylinder groups). Specifically, a rotational variation is produced to the internal combustion engine by injecting fuel to a particular cylinder (cylinder group) only, and cylinder discrimination is produced in accordance with the present rotational variation and the cylinder group identification result so that cylinder discrimination can be effected repeatedly by using the fuel cut mode time even at the time other than the start time of the internal combustion engine, by which the reliability of discrimination is enhanced.

Also, a cylinder discriminating apparatus in accordance with the present invention further has speed change detecting means for detecting a speed change state of the vehicle to inhibit or stop cylinder discrimination made by the cylinder discriminating means when speed change is detected by the speed change detecting means. That is to say, because the rotational variation naturally increases when the vehicle speed changes, mistaken cylinder discrimination is prevented by inhibiting or stopping the cylinder discrimination during speed change.

Further, a cylinder discriminating apparatus in accordance with the present invention has a first rotational variation imparting means which is driven at the start of the internal combustion engine and a second rotational variation imparting means which is driven in a fuel cut mode, and the injection control means has means for controlling the fuel injection for each cylinder on the basis of the cylinder discrimination result determined by the operation of the first rotational variation imparting means during the time from when the internal combustion engine is started to when the cylinder discrimination result is determined by the operation of the second rotational variation imparting means, and controlling the fuel injection for each cylinder on the basis of the cylinder discrimination result determined by the operation of the second rotational variation imparting means after the cylinder discrimination result is determined by the operation of the second rotational variation imparting means.

That is to say, in the fuel cut zone at a start time and at a vehicle decelerating time, the fuel injection amount for a particular cylinder (cylinder group) is made different from that for other cylinders (cylinder groups) in accordance with the state, by which a rotational variation is positively made in the internal combustion engine, and the cylinder discrimination is made on the basis of the rotational variation at each time point and the cylinder group identification result. Thereby, cylinder discrimination is made stably and accurately while making the most of the advantages of both of the states, and without producing adverse effects on the internal combustion engine in each of the above states, and the fuel injection control based on the cylinder identification result is stably carried out.

Another cylinder discriminating apparatus in accordance with the present invention further has steady running detecting means for detecting the steady running state of the internal combustion engine. When the steady running state is detected by the steady running detecting means, the rotational variation imparting means is operated to produce a rotational variation to the internal combustion engine. Thereby, when cylinder discrimination cannot be made at the start, or even when the fuel cut zone at the vehicle decelerating time is not detected after the start, cylinder discrimination can still be made in a stable running state of the vehicle.

Moreover, when the multiple cylinder type internal combustion engine has even-numbered cylinders, the injection control means actuates the fuel injection valve for each cylinder in sequence in accordance with the output of a signal corresponding to each cylinder group from the identifying means before the rotational variation imparting means is operated and after an identification signal for identifying the particular cylinder is generated from the identifying means. Thereby, controlled variable regulating means for regulating a controlled variable relating to the rotational speed of the internal combustion engine is provided to keep said rotational speed at a predetermined speed or higher, so that the decrease in the output of internal combustion engine is prevented even when a cylinder is not yet discriminated.

Also, a cylinder discriminating apparatus in accordance with the present invention further has injection amount setting means for setting the injection amount from the fuel injection valve, so that the transient correction information by the injection amount setting means is set separately at a time when the cylinder discrimination has been completed and a time when the cylinder discrimination is not yet completed, by which a proper fuel amount can be injected regardless of whether or not the cylinder discrimination result can be obtained.

BRIEF DESCRIPTION OF THE DRAWINGS

FIG. 5 is a view showing the concept of group injection of fuel to a first and fourth cylinder group (#1-4) and a third and second cylinder group (#3-2);

FIG. 6 is a view showing the concept of divided group injection to a first and fourth cylinder group (#1-4) and a third and second cylinder group (#3-2);

FIG. 7 is a view showing the concept of general group injection to a first to a fourth cylinders;

FIG. 18 is a view showing fuel injection timing in general sequential injection control for a four-cylinder type internal combustion engine;

FIG. 19 is a view showing fuel injection timing for each cylinder in a fuel interim injection mode when the cylinder is not discriminated;

FIG. 20 is a view showing another example of fuel injection timing for each cylinder in a fuel interim injection mode when the cylinder is not discriminated;

FIG. 22A is a map showing a lower-limit flow rate of idle intake air amount set in accordance with the rotational speed of internal combustion engine, showing correction data for idle intake air amount used when the cylinder is discriminated;

FIG. 22B is a map showing a correction factor set in accordance with the cooling water temperature of internal combustion engine, showing correction data for idle intake air amount used when the cylinder is discriminated;

FIG. 23A is a map showing a water temperature correction factor, showing the transient correction data for acceleration increase amount of fuel;

FIG. 23B is a map showing a rotational speed correction factor, showing the transient correction data for acceleration increase amount of fuel;

FIG. 23C is a map showing an acceleration tailing factor, showing the transient correction data for acceleration increase amount of fuel;

FIG. 24A is a map showing a water temperature correction factor, showing the transient correction data for deceleration decrease amount of fuel;

FIG. 24B is a map showing a rotational speed correction factor, showing the transient correction data for deceleration decrease amount of fuel;

FIG. 24C is a map showing a pressure correction factor, showing the transient correction data for deceleration decrease amount of fuel;

FIG. 24D is a map showing a deceleration tailing factor, showing the transient correction data for deceleration decrease amount of fuel;

FIG. 25A is a map showing a water temperature correction factor, showing the transient correction data for acceleration increase amount in asynchronous fuel injection mode;

FIG. 25B is a map showing a rotational speed correction factor, showing the transient correction data for acceleration increase amount in asynchronous fuel injection mode; and FIG. 25C is a map showing a base fuel injection amount, showing the transient correction data for acceleration increase amount in asynchronous fuel injection mode.

BEST MODE OF CARRYING OUT THE INVENTION

To explain the present invention in more detail, a cylinder discriminating apparatus in accordance with one embodiment of the present invention will be described below with reference to the accompanying drawings.

Figure 1:
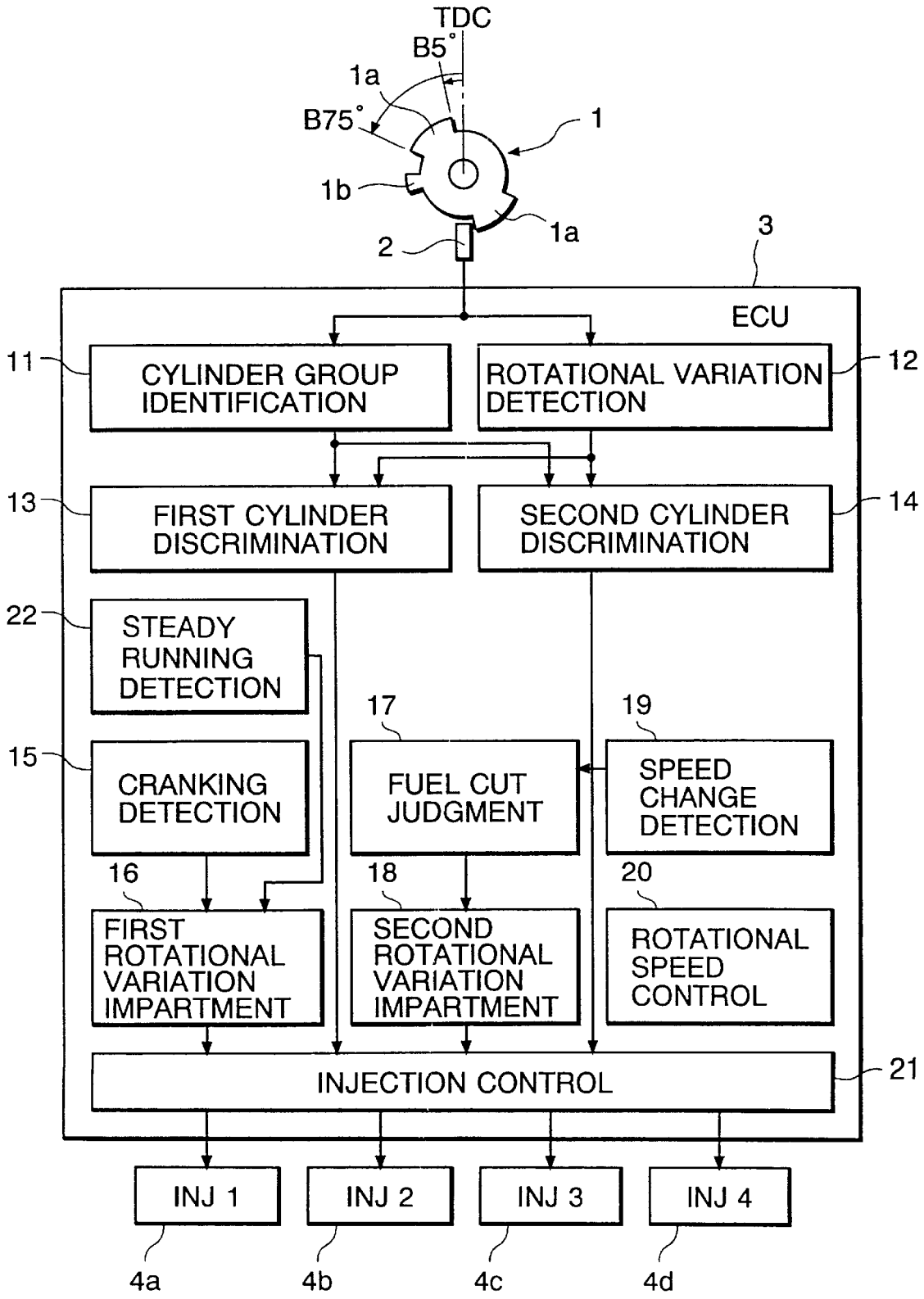
FIG. 1 is a schematic functional configuration view of a cylinder discriminating apparatus in accordance with one embodiment of the present invention.

In FIG. 1, reference numeral 1 denotes a rotating member that is mounted on a crankshaft (not shown), which is a rotating output shaft of a multiple cylinder type internal combustion engine having a plurality of cylinders, and rotates together with the crankshaft. This rotating member 1, called a crank angle sensor plate, constitutes an identifying means for generating a signal in synchronization with the rotation of crankshaft in cooperation with a sensing member 2 consisting of a Hall element arranged at the periphery thereof. The rotating member 1 has a vane structure such that a protrusion 1*a* for generating a signal corresponding to each cylinder or cylinder group of the internal combustion engine and a protrusion 1*b* for generating an identification signal necessary to identify the particular cylinder or the particular cylinder group consisting of two particular cylinders having a 360° different stroke phase are formed in the circumferential direction thereof.

For a four-cylinder type internal combustion engine, for example, the rotating member 1 has two protrusions 1*a* positioned symmetrically with respect to the center for generating two pulse signals for one rotation of the crankshaft by making the pulse signals correspond to each cylinder (cylinder group), the pulse signal having a trailing edge and a leading edge (FIG. 2) corresponding to timing of 5° before the reference (B5°) and 75° before (B75°) in terms of crank angle with the top dead center (TDC) of piston in each cylinder being a reference (0°). Also, the rotating member 1 has a protrusion 1*b* on one side between the protrusions 1*a* for generating an identification signal for determining to which cylinder (cylinder group) the two pulse signals correspond.

Although the details of an electronic control unit (ECU) 3, which constitutes the main part of the cylinder discriminating apparatus in accordance with this embodiment, will be described later, this electronic control unit 3 basically operates by receiving in a signal generated in synchronization with the rotation of the crankshaft by a signal generating means (identifying means) consisting of the rotating member 1 and the sensing member 2. It executes identification of a cylinder group, detection of variations in rotation of the internal combustion engine (crankshaft), and further cylinder discrimination.

Specifically, the electronic control unit 3, as shown in FIG. 1 includes, a microprocessor, memory, etc. in terms of hardware, functionally has cylinder group identifying means 11, rotational variation detecting means 12, first cylinder discriminating means 13, second cylinder discriminating means 14, cranking detecting means 15, first rotational variation imparting means 16, fuel cut judging means 17, second rotational variation imparting means 18, speed change detecting means 19, rotational speed control means 20, injection control means 21, and steady running detecting means 22, as shown in FIG. 1. The injection control means 21 actuates fuel injection valves 4*a*, 4*b*, 4*c*, and 4*d* provided so as to correspond to a plurality of cylinders, and controls fuel injection in each of these cylinders. Although not shown in FIG. 1, the electronic control unit 3, needless to say, incorporates an ignition control device for controlling ignition for each cylinder.

First, a signal obtained by the signal generating means provided with the rotating member 1 and the cylinder group identification based on the signal will be described.

Figure 2:
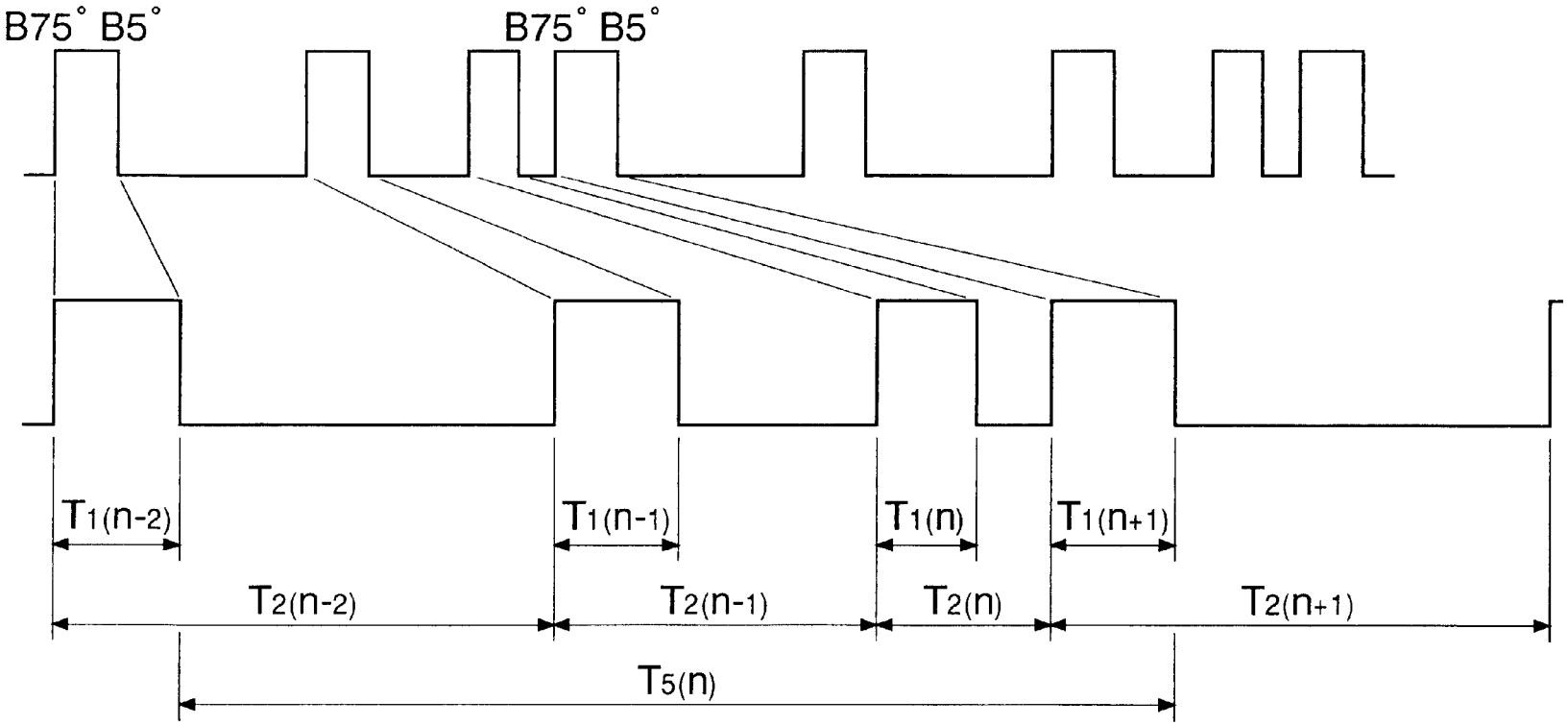
FIG. 2 is a view for illustrating the signal series obtained from a rotating member mounted on a crankshaft and the concept of its pulse identification.

When the internal combustion engine operates and the output rotating shaft (crankshaft) thereof rotates, the rotating member 1 rotates accordingly. Therefore, the sensing member 2 generates a signal series as shown in FIG. 2 in accordance with the protrusions 1*a* and 1*b* of the rotating member 1.

The four-cylinder type internal combustion engine is generally set so that the combustion stroke takes place at equal intervals in the sequence of first cylinder (#1), third cylinder (#3), fourth cylinder (#4), and second cylinder (#2). It is also configured so that each cylinder executes a series of combustion cycles consisting of intake, compression, combustion, and exhaust for every two turns of the crankshaft. One of the two protrusions 1*a* of the rotating member 1 generates a pulse signal indicating the crank angles of B5° and B75° corresponding to the first and fourth cylinders (#1-4) with the top dead center being the reference, and the other protrusion 1*a* generates a pulse signal indicating the crank angles of B5° and B75° corresponding to the second and third cylinders (#2-3) with the top dead center being the reference.

The protrusion 1*b* generates an identification signal for determining whether the pulse signal of B5° and B75° obtained from the two protrusions 1*a* corresponds to the first and fourth cylinders or whether it corresponds to the second and third cylinders. By this identification signal, the pulse signal obtained after this identification signal is identified as one corresponding to the first and fourth cylinders, for example.

Figure 3:
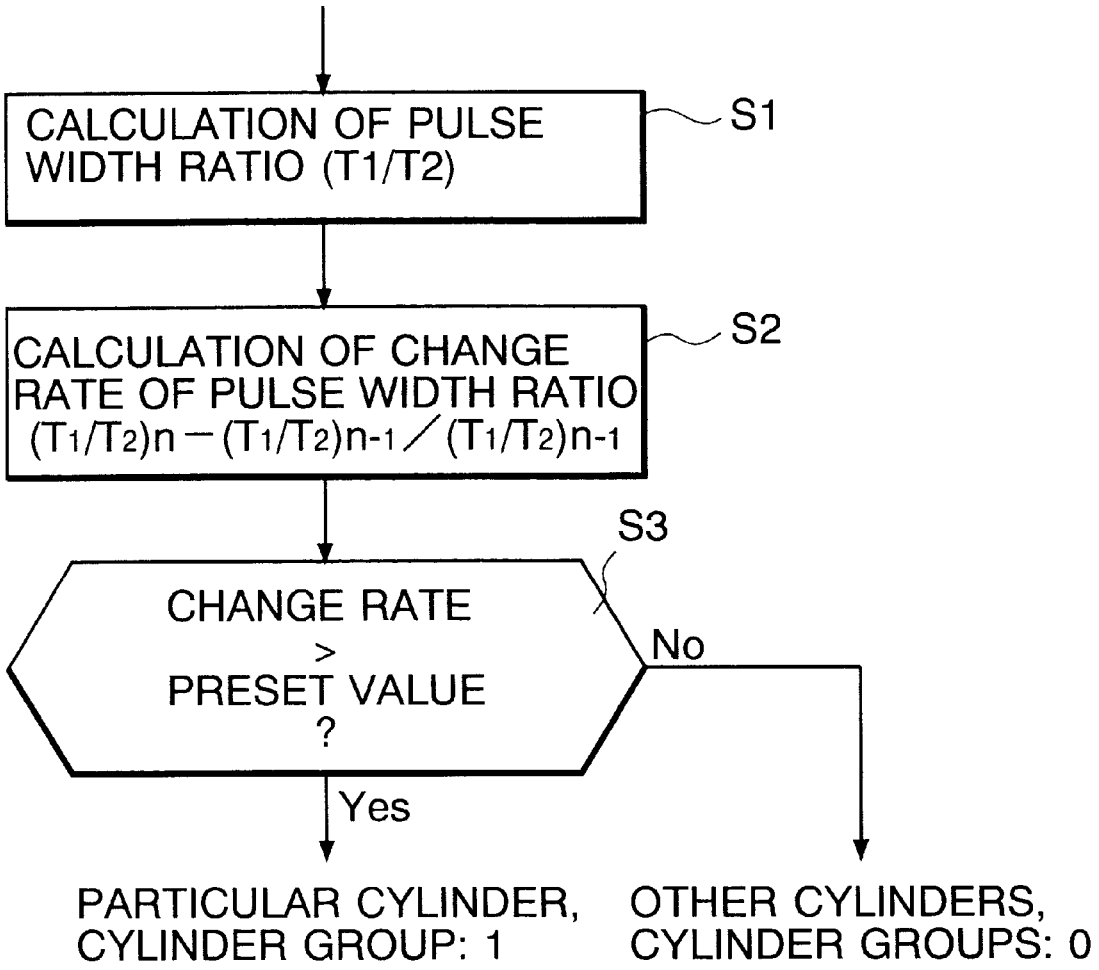
FIG. 3 is a flowchart showing a procedure for pulse identification for the signal series shown in FIG. 2.

The cylinder group identifying means 11 of this embodiment first determines which pulse in the signal series obtained from the signal generating means is the signal indicative of the crank angles of B5° and B75° corresponding to the cylinder (cylinder group) and which pulse is the identification signal. In accordance with the determination result, the signal corresponding to the particular cylinder group, specifically, the pulse signal corresponding to the first and fourth cylinder group (#1-4) is identified. Since the rotational speed of the crankshaft varies depending on the operating conditions of internal combustion engine, both of the signals cannot be distinguished even if only the pulse width of the signal series is simply monitored. As shown in FIG. 3, therefore, the cylinder group identifying means 11 measures the pulse width ratio (duty ratio) of each pulse signal (Step S1), and calculates, in sequence, the change rate of the sequentially measured pulse width ratio (Step S2). When the change rate of the pulse width ratio exceeds a preset value, this signal is detected as the pulse signal corresponding to the particular cylinder group (#1-4) emerging next to the identification signal (Step S3).

Specifically, the cylinder group identifying means 11 sequentially determines the pulse width ratio of each pulse in the signal series obtained from the signal generating means as a ratio ($T_1/T_2$) of a time width $T_1$ from the leading edge to trailing edge of the pulse to a time width $T_2$ from the leading edge to the leading edge of the next pulse. The change rate K of the pulse width ratio ($T_1/T_2$) is sequentially determined as $$K_{n-1}=[(T_1/T_2)_n-(T_1/T_2)_{n-1}]/(T_1/T_2)_{n-1}$$

from the pulse width ratio $(T_1/T_2)_n$ at the present time n and the pulse width ratio $(T_1/T_2)_{n-1}$ of the time (n-1) one pulse before the present time. When this change rate $K_{n-1}$ exceeds a preset value [0.3], for example, the pulse before that pulse is judged to be the pulse signal indicative of the particular cylinder (cylinder group), that is, the pulse signal that emerges next to the identification signal corresponding to the protrusion 1*b* added for cylinder group identification and indicates the cylinder group (#1-4) identified by the identification signal.

More specifically, for example, when the rotational speed during the time when the crankshaft rotates one turn is constant, the pulse width ratios of pulse signals in the signal series shown in FIG. 2 are set as follows:

$$(T_1/T_2)_{n-2}=0.389$$

$$(T_1/T_2)_{n-1}=0.656$$

$$(T_1/T_2)_n=0.499$$

Therefore, the change rate K of the pulse width ratio at each time point is determined sequentially as follows:

$$K_{n-2}=0.686>0.3$$

$$K_{n-1}=-0.239\leqq 0.3$$

$$K_n=-0.220\leqq 0.3$$

The change rate at the next pulse timing (n+1) is determined as $$K_{n+1}=0.0686>0.3$$

From this change rate K of the pulse width ratio, in this case, the pulse at the timing (n−2) is judged to be the pulse signal corresponding to the particular cylinder group (#1-4) emerging just after the identification signal. As a result, in the case of the signal series shown in FIG. 2, the pulse indicated by the timing (n−2) is signal [1] corresponding to the particular cylinder (cylinder group), and two pulses of the succeeding timing (n−1) and (n) are judged to be other signal [0].

Figure 4:
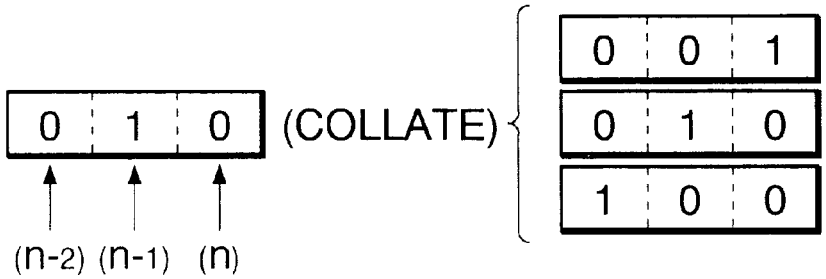
FIG. 4 is a view showing the relationship between the pulse identification result for the signal series shown in FIG. 2 and its standard pattern.

The cylinder group identifying means 11 monitors three continuous judgment results in the signal series judged as described before. In this case, if the judgment result is correct, the judgment result of [1] indicative of the particular cylinder group always emerges only once in the three continuous judgment results. Therefore, the cylinder group identifying means 11 collates the series of judgment signals with three standard patterns indicated as the normal series as shown in FIG. 4, and when the series agrees with any one of these standard patterns, it recognizes that the cylinder group identification result is correct. Also, each time a new pulse is detected from the rotating member 1, the judgment signal series is shifted in sequence and updated. Therefore, the cylinder group identifying means 11 learns the judgment signal series in accordance with the shift pattern, and always obtains the up-to-date cylinder group identification information.

By the above-mentioned cylinder group discrimination, the pulse corresponding to the cylinder group (#1-4) consisting of the first and fourth cylinders, which are the particular cylinders (cylinder group), is detected, and the timing of B5° 1 and B75° of the particular cylinder group (#1-4) is exactly detected from the leading and trailing edges of the pulse, respectively.

When the cylinder group identification information judged as described above cannot be obtained, for example, the fuel injection or ignition for each cylinder is interrupted.

For this apparatus, the particular cylinder is discriminated as described below on the basis of the cylinder group identification information determined based on the signal from the rotating member 1 attached to the crankshaft as described before. The cylinder discrimination is made while fuel is group injected at a preset timing for each cylinder group in accordance with the cylinder group identification information. Generally, the group injection is effected by dividing the cylinders into a cylinder group (#1-3) consisting of the first and third cylinders and a cylinder group (#4-2) consisting of the fourth and second cylinders in accordance with the sequence of combustion stroke that takes place in each cylinder. In this embodiment, however, the cylinders are divided into a cylinder group (#1-4) consisting of the first and fourth cylinders and a cylinder group (#2-3) consisting of the second and third cylinders so as to correspond to the signal (pulse) from the rotating member 1 described before, and for example, as shown in FIG. 5, each time the crankshaft rotates two turns for each combustion cycle, including intake (IN), compression (CP), combustion (CB), and exhaust (EX) strokes, fuel is group injected as indicated by the solid line cross hatching once for each cylinder. Alternatively, the fuel injection amount of one time is decreased to a half, and as shown in FIG. 6, each time the crankshaft rotates one turn, fuel is group injected dividedly.

It is also possible that fuel is group injected at a timing indicated by the solid line and broken line cross hatching in FIG. 7, for example, for the two cylinder groups (#1-3) and (#4-2), which is a general group injection mode. In this case, however, only the particular cylinder group (#1-4) can be discriminated in the above-described cylinder group discrimination, so that there is a possibility that fuel injection is effected in each stroke of intake (IN) and compression (CP) as indicated by broken line cross hatching in FIG. 7. In particular, there is a possibility that fuel injection is effected at the timing at which the intake valve is open from the later half of intake (IN) stroke, which is a combustion deteriorated region, to the earlier half of the compression (CP) stroke. Such a fuel injection timing is undesirable for the so-called port injection type engine. For the in-cylinder direct injection type engine, however, group injection can be effected for the above-mentioned cylinder groups (#1-3) and (#4-2) because deterioration in combustion causes a big problem. It is also possible that the cylinder discrimination is made while fuel is injected simultaneously to all cylinders once for each combustion cycle at a timing based on the identification information of cylinder group (#1-4).

Here, however, the following cylinder discrimination will be described assuming that fuel is group injected for the two cylinder groups (#1-4) and (#3-2) at the timing shown in FIG. 5.

Figure 8:
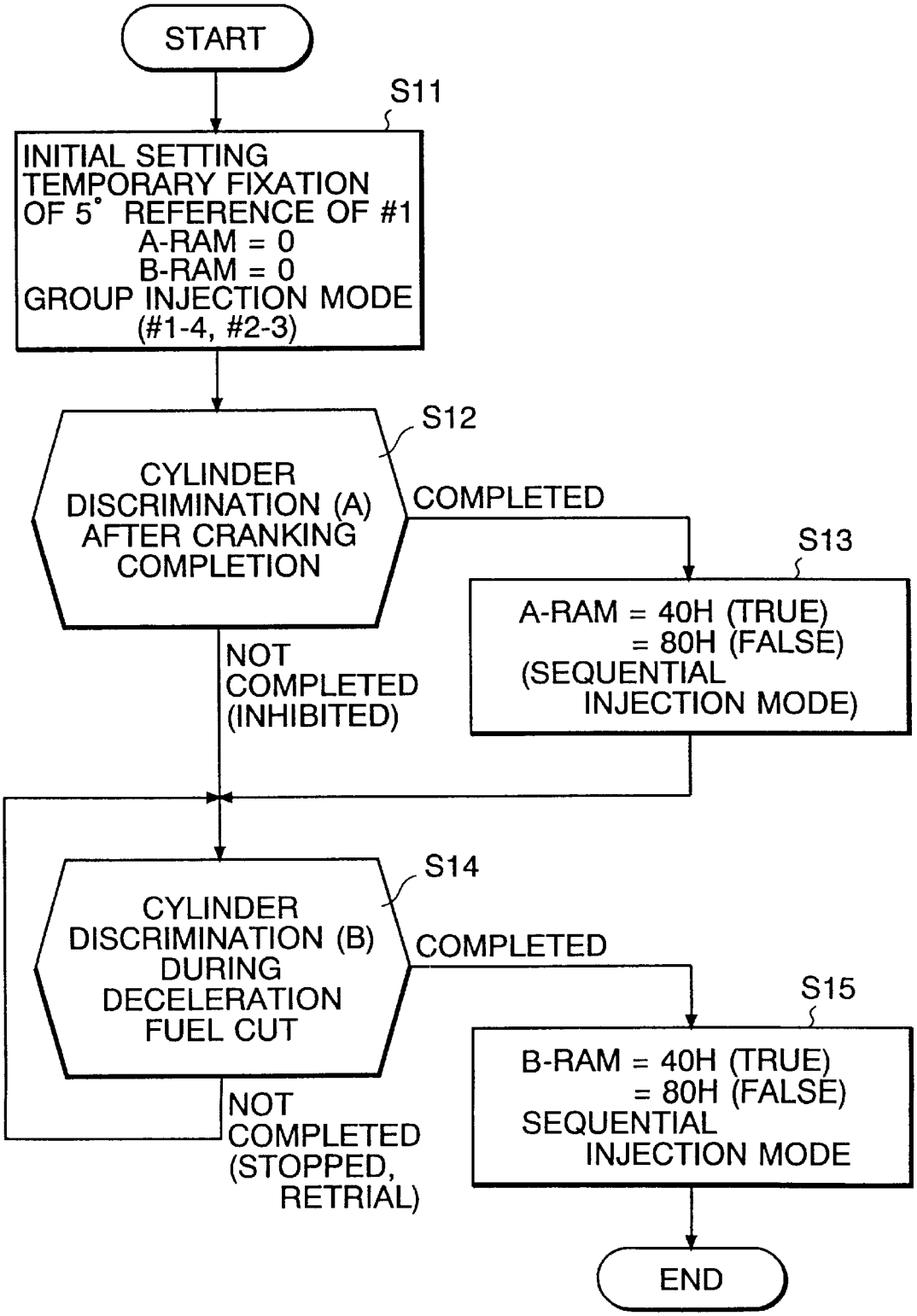
FIG. 8 is a flowchart showing an example of general procedure for cylinder discrimination in the apparatus of the embodiment.

FIG. 8 is a flowchart showing a general procedure for cylinder discrimination in the apparatus of this embodiment. This procedure is started by initially setting the contents of two registers A-RAM and B-RAM for storing the cylinder discrimination result to [0] assuming that one of pulses indicating the cylinder group (#1-4) corresponds to the first cylinder (#1) and taking the B5° timing as the reference timing (B5° reference), in accordance with the above-mentioned cylinder group discrimination result (Step S11). Then, a first cylinder discrimination is executed by the first cylinder discriminating means 13 (Step S12).

This first cylinder discrimination step is executed by detecting the cranking completion of the internal combustion engine by the cranking detecting means 15 to activate the first rotational variation imparting means 16, driving the injection control means 21 under the control of the first rotational variation imparting means 16, and detecting the rotational variation of the internal combustion engine at this time by the rotational variation detecting means 12. In particular, this first cylinder discrimination step is executed by detecting the present rotational variation of the internal combustion engine by the rotational variation detecting means 12 while fuel injection to the first cylinder (#1) is stopped (fuel cut), or while the fuel injection amount is decreased. The first cylinder discrimination is made by judging whether the reference timing (B5° reference) assumed as described above from the rotational variation truly corresponds to the first cylinder, or whether the assumption is inversely false and truly the reference timing corresponds to the fourth cylinder. When the above-mentioned assumption is judged to be true or false, the judgment result is stored in the register A-RAM, thereby completing the cylinder discrimination (Step S13). At this time, the control may transfer to a sequential injection mode on the basis of the cylinder discrimination result. Here, however, another cylinder discrimination step is further executed.

Although the cylinder discrimination in Step S12 is described in detail later, the cylinder discrimination is basically made by forming an operating environment in which deterioration in combustion or misfire occurs in the first cylinder by decreasing the fuel amount injected to the first cylinder as compared with the fuel amount injected to the other cylinders in accordance with the B5° reference assumed on the basis of the cylinder group identification result, and by determining whether or not rotational variation is produced due to this environment by using the rotational variation detecting means 12. When deterioration in combustion or misfire occurs in the first cylinder and the rotational variation is produced, the assumption is judged to be true and the data [40H] is stored in the register A-RAM. When rotational variation is not detected even if the fuel amount injected to the first cylinder is controlled, the assumption is judged to be false and the data [80H] is stored in the register A-RAM, thereby completing the judgment.

When the judgment result that the assumption is true or false cannot be obtained in this cylinder discrimination step, that is, when judgment cannot be made, or when the reliability of judgment result is low, the first cylinder discrimination shown in Step S12 is stopped at that time.

When the cylinder discrimination has been made by the first cylinder discrimination or the first cylinder discrimination has failed, a second cylinder discrimination, described below, is executed by using the second cylinder discriminating means 14 (Step S14). This second cylinder discrimination, which reconfirms the judgment result obtained by the aforementioned first cylinder discrimination, or executes cylinder discrimination from another viewpoint in case of the failure of the first cylinder discrimination, is made by using the fuel cut mode time for each cylinder group when the vehicle speed decreases.

Although the second cylinder discrimination in Step S14 is described in detail later, the cylinder discrimination is basically made by detecting the fuel cut mode time for each cylinder (cylinder group) by the fuel cut judging means 17 to activate the second rotational variation imparting means 18, and by injecting fuel to the first cylinder (#1) only. That is, the cylinder discrimination is made by determining whether or not a rotational variation is produced by the rotational variation detecting means 12 by making the fuel injection amount for the first cylinder different from the fuel injection amount for other cylinders. When the rotational variation is detected and the assumption is judged to be true, the data [40H] is stored in the register B-RAM. On the other hand, when the rotational variation is not detected and the assumption is judged to be false, the data [80H] is stored in the register B-RAM, thereby completing the judgment (Step S15). Then, the control transfers to a sequential injection mode in accordance with the cylinder discrimination result.

When the judgment result that the assumption is true or false cannot be obtained in this cylinder discrimination step, that is, when judgment cannot be made, or when the reliability of judgment result is low, the second cylinder discrimination shown in Step S14 is repeatedly executed at a preset timing. When the second cylinder discrimination result stored in the register B-RAM differs from the first cylinder discrimination result stored in the register A-RAM, the second cylinder discrimination result is preferentially used and sequential injection is executed.

Thus, in the apparatus of this embodiment, the cylinder discrimination for the cylinder groups (#1-4) and (#2-3) when fuel is group injected is executed by using the first cylinder discriminating means 13 and second cylinder discriminating means 14. However, it is, needless to say, possible to configure the apparatus so as to execute only the cylinder discrimination for one cylinder group.

Next, the first and second cylinder discrimination will be described in more detail.

Figure 9:
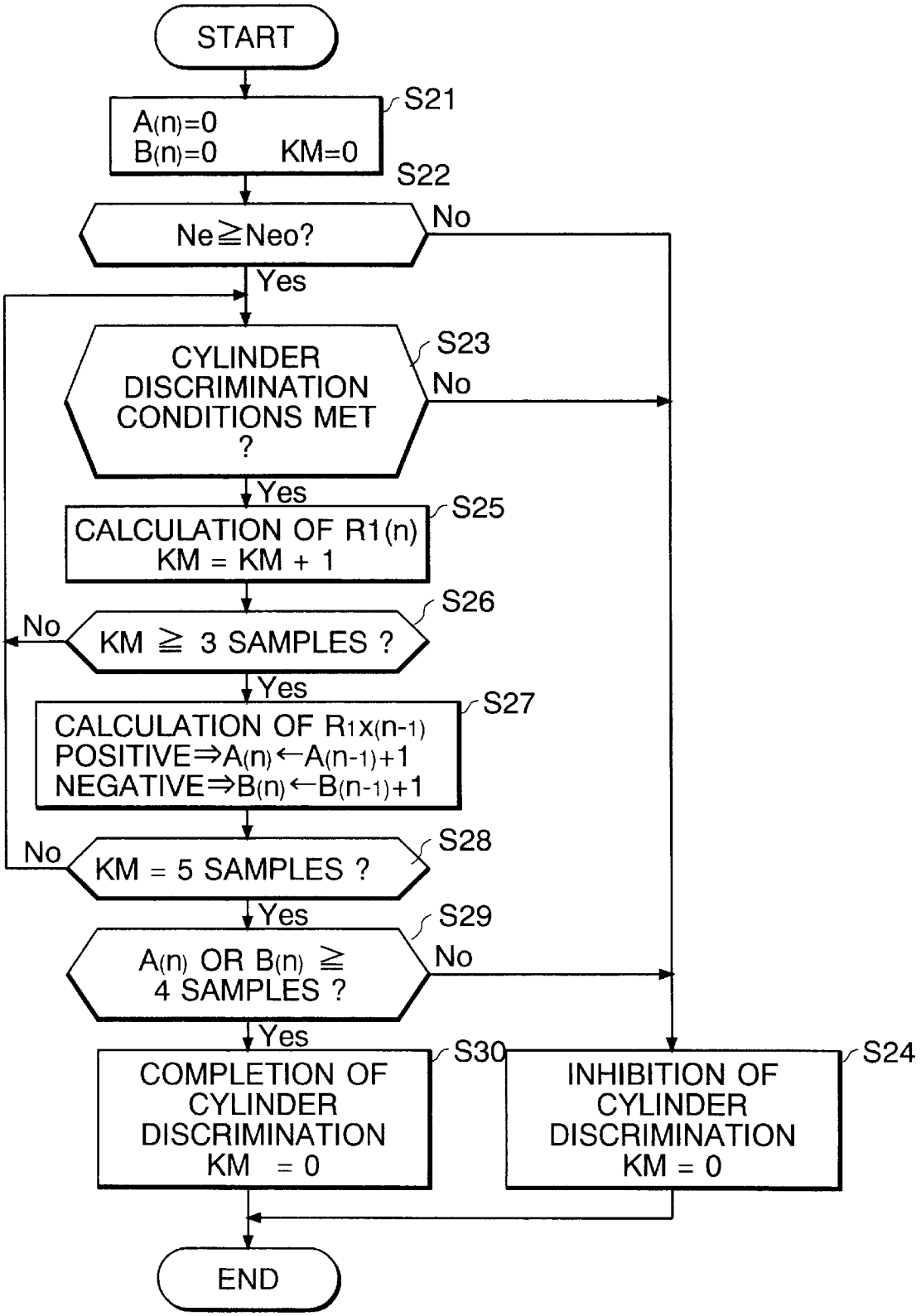
FIG. 9 is a flowchart showing a procedure for a first cylinder discrimination at engine start.

In the first cylinder discrimination, as described above, after the cranking is completed at the engine start, the fuel injection amount for the first cylinder (#1) is decreased, or fuel is cut in an extreme case, and it is determined from the present variations in rotational speed whether or not this causes deterioration in combustion (misfire) in the first cylinder, by which cylinder discrimination is made. The cylinder discrimination is made by following the procedure shown in FIG. 9.

This cylinder discrimination is started by initially setting two judgment result registers $A_{(n)}$ and $B_{(n)}$ to [0] and initially setting a control parameter KM corresponding to the combustion cycle to [0] (Step S21). Then, the cranking completion of the engine is judged by determining whether or not the engine rotational speed Ne at the start exceeds a predetermined rotational speed Ne0, for example, 1200 rpm, by means of the cranking detecting means 15 (Step S22). By this judgment, the cylinder discrimination in an unstable operation state of internal combustion engine in cranking is inhibited.

When the stable state of engine is detected, it is determined whether or not the conditions for executing the first cylinder discrimination are met (Step S23). In this determination, it is determined whether the present water temperature is not lower than a predetermined value WT (for example, 10° C.) in order to inhibit cylinder discrimination at a low water temperature time at which there is fear of engine stall, it is determined whether the current engine rotational speed $R_{2(n)}$ is not lower than a predetermined rotational speed (for example, 700 rpm) at which there is fear of engine stall, and it is determined whether the cylinder discrimination is not completed in order to execute the first cylinder discrimination only once after engine start. When not all these conditions are met, that is, when even one condition is not met, the first cylinder discrimination scheduled to be executed subsequently is inhibited, and the control parameter KM is reset to [0] for the restart of the engine (Step S24).

When the aforementioned conditions for cylinder discrimination are met, the first rotational variation imparting means 16 is activated to decrease the fuel injection amount for the first cylinder as compared with the other cylinders, and the present rotational speed is detected by the rotational variation detecting means 12. At this time, the control parameter KM is increased by one (Step S25).

Figure 10:
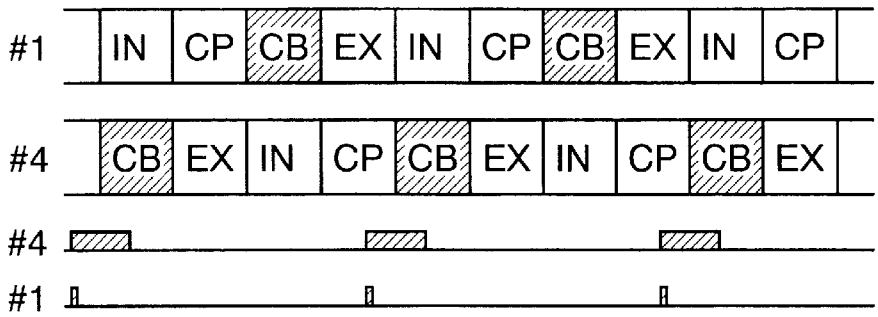
FIG. 10 is a view showing timing of injected fuel decrease (fuel cut) for the first cylinder in group injection.

The decrease (cut) of fuel amount injected to the first cylinder by the first rotational variation imparting means 16 is effected at the group injection timing as shown by the solid line cross hatching in FIG. 10 by taking the B5° timing when assuming that one of pulse signals indicative of the cylinder group (#1-4) corresponds to the first cylinder (#1) as the reference. That is, at the group injection timing of fuel set from the later half of the exhaust (EX) stroke to the earlier half of intake (IN) stroke of the first cylinder, the decrease (cut) of fuel amount injected to the first cylinder is executed. For the fourth cylinder at the timing from the later half of the compression stroke to the earlier half of the combustion (CB) stroke, however, fuel injection is effected as usual. When the above assumption is false, the timing of decrease (cut) of fuel amount injected to the first cylinder actually becomes the timing from the later half of the compression stroke to the earlier half of the combustion stroke of the first cylinder. However, to the fourth cylinder at the timing from the later half of the exhaust stroke to the earlier half of the intake stroke, a constant amount of fuel is injected without being decreased.

The rotational variation detecting means 12 sequentially determines the engine rotational speed $R_{1(n)}$ in the combustion cycle at the time when the decrease (cut) of fuel amount injected to the first cylinder as $$R_{1(n)}=60\times1000000/T_{(n)}\ [\text{rpm}]$$

from, for example, the time taken for one rotation of crankshaft, that is, the time $T_{(n)}$ [μsec] taken for one rotation of the aforesaid rotating member 1. For the rotational speed $R_{2(n)}$ used for judgment of cylinder discriminating conditions in the aforesaid Step 23, a value calculated, for example. as $$R_{2(n)}=60\times1000000/(T_{(n)}+T_{(n-1)})/2\ [\text{rpm}]$$

from the mean value of time taken for the crankshaft to continuously rotate two turns, $(T_{(n)}+T_{(n-1)})/2$, taking one combustion cycle to be a unit, may be used.

Figure 11:
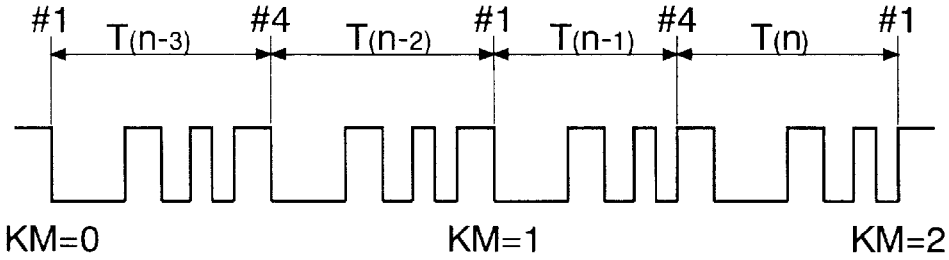
FIG. 11 is a view showing detection timing of rotational speed.

The detection of the rotational speed $R_{1(n)}$ is repeatedly executed throughout three combustion cycles until the control parameter KM reaches a preset value [3] per the timing shown in FIG. 11 (Step S26). Each time the rotational speeds $R_{1(n)}$, $R_{1(n-1)}$, $R_{1(n-2)}$ for continuous three samples with the B5° timing of the first cylinder (#1) being the reference are determined, the rotational variation detecting means 12 determines the present rotational variation as $$R_{1x(n-l)}=R_{1(n-1)}-\{R_{1(n-2)}+R_{1(n)}\}/2$$

and determines whether the calculated value $R_{1x(n-1)}$ is positive or negative. If the calculated value $R_{1x(n-1)}$ is negative, the value $A_{(n)}$ of the judgment result register A-RAM is increased by one, and inversely if the calculated value $R_{1x(n-1)}$ is positive, the value $B_{(n)}$ of the judgment result register B-RAM is increased by one (Step S27). This operation is repeatedly executed throughout five combustion cycles until the control parameter KM reaches a preset value [5], for example, each time the rotational speeds for continuous three samples are determined (Step S28).

Figure 12:
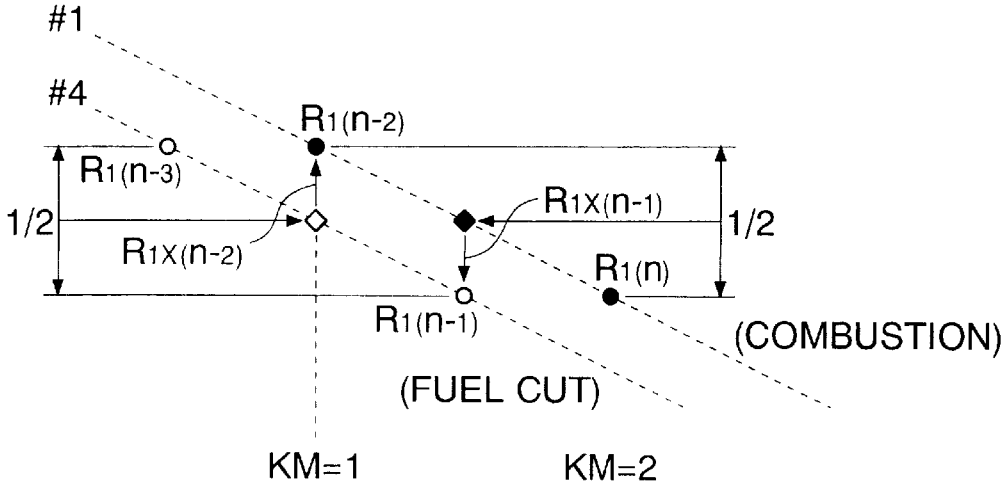
FIG. 12 is a view schematically showing the concept of identification of rotational variation.

The rotational variation detecting means 12 sequentially determines the rotational speed $R_{1(n)}$ at the B5° timing for each rotation of crankshaft as described above to investigate the presence of rotational variation caused by decrease (cut) of fuel amount injected to the first cylinder at the time of group injection mode as shown in FIG. 5. FIG. 12 schematically shows the principle of detection of rotational variation. As shown in this figure, the value $R_{1x(n-1)}$ is determined as an index of rotational variation. The $R_{1x(n-1)}$ is the difference between the mean value of the rotational speeds $R_{1(n-2)}$ and $R_{1(n)}$ of the first cylinder determined with the B5° timing being the reference and the rotational speed $R_{1(n-1)}$ of the fourth cylinder at the B5° timing, which lies at the intermediate position of $R_{1(n-2)}$ and $R_{1(n)}$. The mean value of the rotational speeds $R_{1(n-2)}$ and $R_{1(n)}$ is determined for the case where the rotational speed of engine does not change greatly.

Referring to FIG. 12, the principle of detection of rotational variation will be described in more detail. When the B5° reference of the first cylinder assumed as described above is correct, the timing at which the combustion of the first cylinder, in which injected fuel is decreased (cut) at the timing of B5° reference, affects the rotational variation is just the timing of B5° reference of the fourth cylinder. Inversely, the timing at which the combustion of the fourth cylinder affects the rotational variation is the timing of B5° reference of the first cylinder. Therefore, the rotational speeds $R_{1(n-2)}$ and $R_{1(n)}$ at the timing (n—2) and (n) determined for each B5° reference are the rotational speeds affected by the combustion of the fourth cylinder. Inversely, the rotational speeds $R_{1(n-3)}$ and $R_{1(n-1)}$ of the fourth cylinder determined at the B5° timing (n−3) and (n−1), which are the intermediate timing of B5° reference of the first cylinder, are the rotational speeds affected by the combustion of the first cylinder, in which injected fuel is decreased (cut).

Accordingly, as shown in FIG. 12, the rotational speeds $R_{1(n-2)}$ and $R_{1(n)}$ determined for each B5° reference depends on the combustion of the fourth cylinder. Also, the rotational speeds $R_{1(n-3)}$ and $R_{1(n-1)}$ of the fourth cylinder at the B5° timing depends on the combustion of the first cylinder, in which fuel is decreased (cut), so that the rotational speed is decreased by the deterioration in combustion (misfire) caused by fuel decrease (cut). In this case, since the relationship of $R_{1(n-1)}<R_{1(n-2)}, R_{1(n)}$ holds, the difference $R_{1x(n-1)}$ in rotational speeds determined as described above is negative.

When the above-mentioned assumption of the B5° reference for the first cylinder is false, the rotational speeds $R_{1(n-2)}$ and $R_{(n)}$ determined by assuming that the rotational speeds depend on the combustion of the fourth cylinder for each B5° reference actually depend on the first cylinder, and the fuel decrease (cut) for the first cylinder is effected in that combustion cycle, so that the rotational speed decreases. Also, the rotational speeds $R_{1(n-3)}$ and $R_{1(n-1)}$ of the fourth cylinder determined by assuming that the rotational speeds depend on the combustion of the first cylinder at the B5° timing of the fourth cylinder actually depend on the fourth cylinder, so that the rotational variation depending on the fuel decrease (cut) does not occur. In this case, therefore, since the relationship of $R_{1(n-1)}>R_{1(n-2)}, R_{1(n)}$ holds, the difference $R_{1x(n-1)}$ in rotational speeds determined as described above is positive.

In the detection of rotational variation in Step S27, if the difference $R_{1x(n-1)}$ in rotational speeds determined as described above is negative, the value $A_{(n)}$ of the judgment result register A-RAM is increased by one, and if the difference is positive, the value $B_{(n)}$ of the judgment result register B-RAM is increased by one. When the difference $R_{1x(n-1)}$ in rotational speeds is zero [0], it is judged that the judgment is impossible, and neither of the value $A_{(n)}$ of the judgment result register A-RAM nor the value $B_{(n)}$ of the judgment result register B-RAM is increased by one. Such a judgment is repeatedly executed throughout five combustion cycles in accordance with the control parameter KM.

After the detection of rotational variation throughout five continuous combustion cycles is completed, it is determined whether the value $A_{(n)}$ of the judgment result register A-RAM or the value $B_{(n)}$ of the judgment result register B-RAM is not lower than a preset value, for example, [4] (Step S29). If any one of the value $A_{(n)}$ of the judgment result register A-RAM and the value $B_{(n)}$ of the judgment result register B-RAM is not lower than [4], specifically, if the value $A_{(n)}$ of the judgment result register A-RAM is not lower than [4], it is judged that the B5° reference of the first cylinder assumed as described above is correct. Inversely, if the value $B_{(n)}$ of the judgment result register B-RAM is not lower than [4], it is judged that the B5° reference of the first cylinder assumed as described above is mistaken and actually the correct B5° reference corresponds to the fourth cylinder, and the cylinder discrimination is completed (Step S30). At this time, the control parameter KM is reset to [0] for the next cylinder discrimination (restart of that engine). If neither the value $A_{(n)}$ of the judgment result register A-RAM nor the value $B_{(n)}$ Of the judgment result register B-RAM reaches [4], it is judged that the cylinder discrimination could not be made exactly, and the cylinder discrimination is stopped.

In the above-described first cylinder discrimination, it is preferable that the controlled variable relating to the rotational speed be adjusted by operating, for example, the rotational speed control means 20, and more specifically, the air-fuel ratio be adjusted by clipping the intake air amount in idling operation at the predetermined lower limit value, and control be carried out so that the rotational speed exceeds the target idle rotational speed, thereby taking measures against engine stall etc.

According to the above-described first cylinder discrimination, since the cylinder discrimination is made by decreasing the fuel injected to the first cylinder immediately after the engine start, a state in which the cylinder discrimination is not made can be effectively prevented from continuing for a long period of time. Moreover, since the cylinder discrimination is executed in a short period of time just after the start of internal combustion engine, there is no possibility that driving feeling is adversely affected.

According to the above-described detection of rotational variation, since the evaluation value $R_{1x(n)}$ is determined as a negative value in the cylinder of deteriorated combustion (misfire), and as a positive value in the combustion cylinder, the judgment level can be defined as zero [0], and no complicated matching operation etc. are needed. Accordingly, the cylinder discrimination based on the rotational variation can be executed simply and reliably.

Further, since only the fuel injection amount for the particular cylinder has to be decreased to an extent that the rotational variation occurs, the cylinder can be discriminated without complete misfire of the particular cylinder, so that the deterioration in driving feeling does not occur. Also, since complete misfire does not take place, the activation of a catalyst for exhaust system is not affected adversely, so that the cylinder discrimination can be made reliably.

Figure 13:
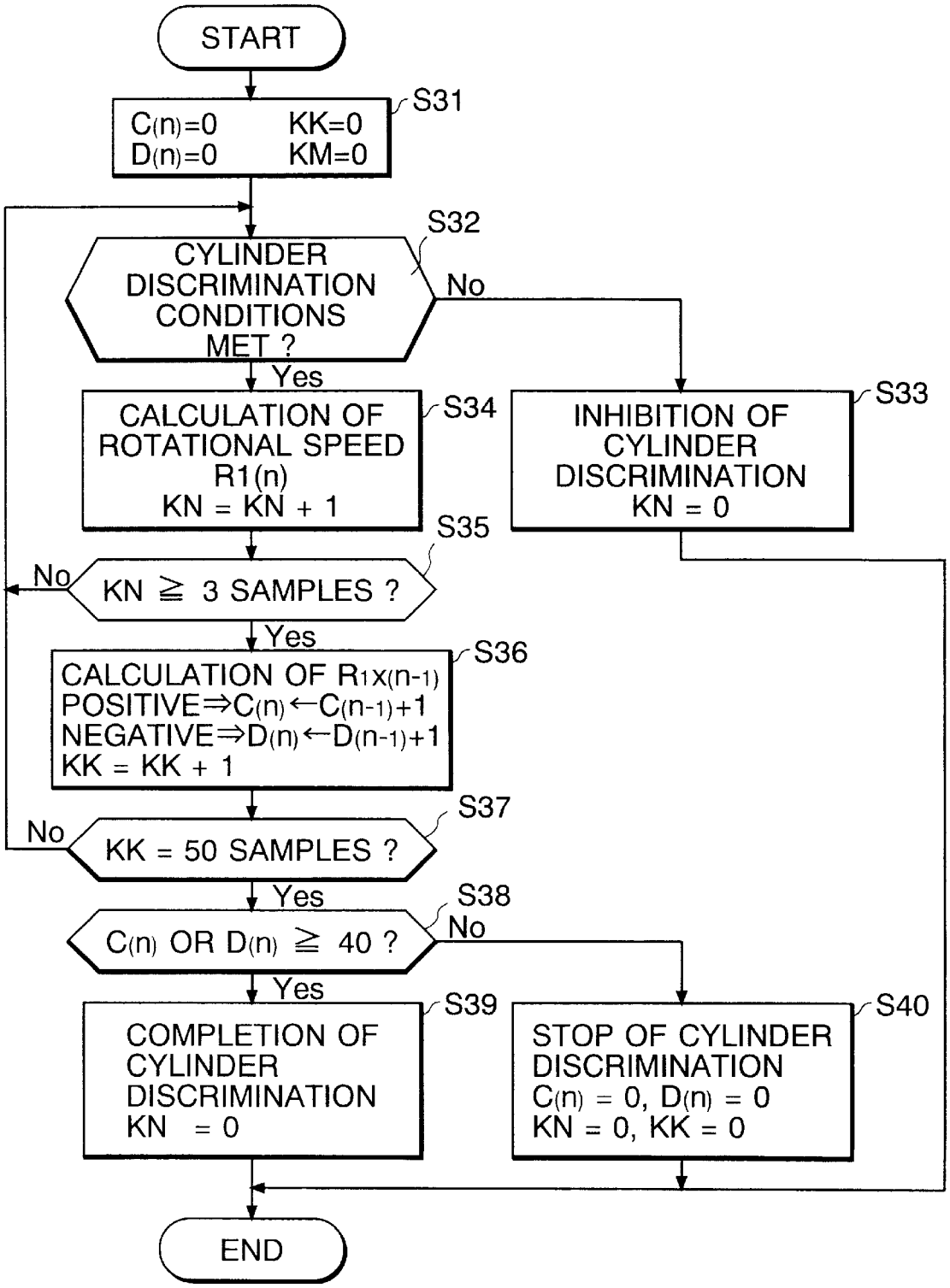
FIG. 13 is a flowchart showing a procedure for a second cylinder discrimination in fuel cut mode.

The second cylinder discrimination is made by the procedure, for example, shown in FIG. 13. This procedure s started by initially setting the values $C_{(n)}$ and $D_{(n)}$ of two judgment result registers C-RAM and D-RAM, respectively, to [0], and by initially setting two control parameters KM and KK corresponding to the combustion cycle to [0] (Step S31). Subsequently, it is determined whether or not the conditions for executing the cylinder discrimination are met (Step S32).

This determination is made, for example, by determining whether or not the vehicle is being decelerated and the injection of fuel to the engine is cut by using the fuel cut judging means 17, and whether or not the vehicle speed is being changed by using the speed change detecting means 19. Specifically, it is determined whether or not the air amount regulating means (for example, a throttle valve) is fully closed, and the engine rotational speed $R_{2(n)}$ at that time is higher than the predetermined rotational speed (for example, 1500 rpm) at which the operating condition in a fuel cut mode is realized. Also, the determination is made by making sure that the change in rotational speed at that time is not so great as the change in rotational speed at the speed change time, and further by making sure whether the cylinder discrimination had not been completed already. When not all these conditions are met, that is, when even one condition is not met, the second cylinder discrimination scheduled to be executed subsequently is inhibited, and the control parameter KN is reset to [0] for the next cylinder discrimination in a fuel cut mode (Step S33).

When the above-mentioned conditions for the second cylinder discrimination are met, the second rotational variation imparting means 18 is then activated to inject fuel to the first cylinder (#1) only, and the current rotational speed is detected by the rotational variation detecting means 12. Then, the control parameter KN, which indicates that the fuel injection amount is increased, is increased by one (Step S34).

The control of the increase in fuel amount injected to the first cylinder by the second rotational variation imparting means 18 is carried out, as with the case of the above-described first cylinder discrimination, at the group injection timing by taking the B5° timing when assuming that one of pulse signals indicative of the cylinder group (#1-4) corresponds to the first cylinder (#1) as the reference. That is, at the group injection timing of fuel set from the later half of the exhaust stroke to the earlier half of intake stroke of the first cylinder, the injection of fuel to the first cylinder is executed. For the fourth cylinder at the timing from the later half of the compression stroke to the earlier half of the combustion stroke, however, the fuel cut state is kept as usual.

When the above assumption is false, the timing of fuel injection to the first cylinder actually becomes the timing from the later half of the compression stroke to the earlier half of the combustion stroke of the first cylinder. However, for the fourth cylinder at the timing from the later half of the exhaust stroke to the earlier half of the intake stroke, the fuel cut state is maintained.

The rotational variation detecting means 12 sequentially determines the rotational speed $R_{1(n)}$ in the combustion cycle at the time when fuel is injected to the first cylinder only on condition that the control is in a fuel cut mode.

The detection of the rotational speed $R_{1(n)}$ at this time is repeatedly executed for a period such that the control parameter KN reaches a preset value [3], that is, throughout three continuous combustion cycles (Step S35). Each time the rotational speeds $R_{1(n)}$, $R_{1(n-1)}$, $R_{1(n-2)}$ for continuous three samples with the B5° timing of the first cylinder (#1) being the reference are determined, the rotational variation detecting means 12 determines the present evaluation value $R_{1x(n-1)}$ for rotational variation as described before, and determines whether the calculated value $R_{1x(n-1)}$ is positive or negative. If the calculated value $R_{1x(n-1)}$ is positive, the value $C_{(n)}$ of the judgment result register C-RAM is increased by one, and inversely if the calculated value $R_{1x(n-1)}$ is negative, the value $D_{(n)}$ of the judgment result register D-RAM is increased by one (Step S36)

This operation is repeatedly executed throughout fifty combustion cycles while the control parameter KK is increased incrementally until the value thereof reaches a preset value [50], for example, each time the rotational speeds for continuous three samples are determined (Step S37).

The rotational variation detecting means 12 sequentially determines the rotational speed $R_{1(n)}$ at the B5° timing for each rotation of crankshaft as described above to investigate the presence of rotational variation caused by fuel injection to the first cylinder as described above in a fuel cut mode. The difference $R_{1x(n-1)}$ between the mean value of the rotational speeds $R_{1(n-2)}$ and $R_1(n)$ of the first cylinder determined with the B5° timing being the reference and the rotational speed $R_{1(n-1)}$ of the fourth cylinder at the B5° timing, which lies at the intermediate position of $R_{1(n-2)}$ and $R_{1(n)}$, is determined as an index of rotational variation.

Next, the operation of the detection of rotational variation will be described in more detail. When the B5° reference of the first cylinder assumed as described above is correct, the timing affected by the combustion of the first cylinder, to which fuel is injected at the timing of B5° reference, is just the B5° timing of the fourth cylinder. Inversely, the timing affected by the combustion of the fourth cylinder is the B5° timing (B5° reference) of the first cylinder. Therefore, the rotational speeds $R_{1(n-2)}$ and $R_{1(n)}$ at the timing (n−2) and (n) determined for each B5° reference are the rotational speeds affected by the combustion of the fourth cylinder. The rotational speeds affected by the combustion of the first cylinder, to which fuel is injected at the time of fuel cut, are detected as the rotational speeds $R_{1(n-3)}$ and $R_{1(n-1)}$ determined at the B5° timing (n−3) and (n−1) of the fourth cylinder, which is the intermediate timing of B5° reference of the first cylinder.

As shown in FIG. 12, therefore, the rotational speeds $R_{1(n-2)}$ and $R_{1(n)}$ determined for each B5° reference of the first cylinder depend on the fourth cylinder in a fuel cut state, so that rotational variation does not occur. However, the rotational speeds $R_{1(n-3)}$ and $R_{1(n-1)}$ determined at the B5° timing of the fourth cylinder are higher than the rotational speed at the ordinary fuel cut time because they depend on the combustion of the first cylinder to which fuel is injected. In this case, therefore, $$R_{1(n-1)} > R_{1(n-2)}, R_{1(n)}$$

so that the difference $R_{1x(n-1)}$ in rotational speed determined as described above becomes positive.

If the assumption of the B5° reference of the first cylinder described above is false, the rotational speeds $R_{1(n-2)}$ and $R_{1(n)}$ determined for each B5° reference assuming that they depend on the fourth cylinder in a fuel cut state actually depend on the combustion of the first cylinder to which fuel is injected, so that the rotational speed is increased by the combustion of fuel. Also, the rotational speeds $R_{1(n-3)}$ and $R_{1(n-1)}$ determined at the B5° timing of the fourth cylinder assuming that they depend on the combustion of the first cylinder actually depend on the fourth cylinder in a fuel cut state. In this case, therefore, $$R_{1(n-1)} < R_{1(n-2)}, R_{1(n)}$$

so that the difference $R_{1x(n-1)}$ in rotational speed determined as described above becomes negative.

In the detection of rotational variation in Step S36, if the difference $R_{1x(n-1)}$ in rotational speeds determined as described above is positive, the value $C_{(n)}$ of the judgment result register C-RAM is increased by one, and if the difference is negative, the value $D_{(n)}$ of the judgment result register D-RAM is increased by one. When the difference $R_{1x(n-1)}$ in rotational speeds is zero [0], it is judged that the judgment is impossible, and neither of the value $C_{(n)}$ of the judgment result register C-RAM nor the value $D_{(n)}$ of the judgment result register D-RAM is increased by one. Such a judgment is repeatedly executed throughout fifty combustion cycles in accordance with the control parameter KK.

After the detection of rotational variation throughout fifty combustion cycles is completed, it is determined whether the value $C_{(n)}$ of the judgment result register C-RAM or the value $D_{(n)}$ of the judgment result register D-RAM is not lower than a preset value, for example, [40] (Step S38). If either of the value $C_{(n)}$ of the judgment result register C-RAM and the value $D_{(n)}$ of the judgment result register D-RAM is not lower than [40], specifically, if the value $C_{(n)}$ of the judgment result register C-RAM is not lower than [40], it is judged that the B5° reference of the first cylinder assumed as described above is correct. Inversely, if the value $D_{(n)}$ of the judgment result register D-RAM is not lower than [40], it is judged that the B5° reference of the first cylinder assumed as described above is mistaken and actually the correct B5° reference corresponds to the fourth cylinder, and the cylinder discrimination is completed (Step S39). When this cylinder discrimination is completed, the control parameter KN is reset to [0] for the next cylinder discrimination.

If both of the value $C_{(n)}$ of the judgment result register C-RAM and the value $D_{(n)}$ of the judgment result register D-RAM are lower than [40], it is judged that the cylinder discrimination cannot be made, and the cylinder discrimination is stopped (Step S40). In this case, the aforesaid value $C_{(n)}$ of the judgment result register C-RAM and value $D_{(n)}$ of the judgment result register D-RAM and the control parameters KN and KK are reset to [0] for the next cylinder discrimination.

In the second cylinder discrimination as well, it is preferable that the controlled variable relating to the rotational speed be adjusted by operating, for example, the rotational speed control means 20, and more specifically, the air-fuel ratio be adjusted by clipping the intake air amount in idling operation at the predetermined lower limit value, or the manifold pressure be increased, thereby taking measures against engine stall etc. Also, the fuel injection in the fuel cut mode may be limited so that the fuel injection is not executed unless the injected fuel burns actually. If such measures are taken, the rotational variation detecting accuracy is improved, and the catalyst provided in the exhaust system is preferably protected.

According to this second cylinder discrimination, fuel is injected to the particular cylinder only at the time of fully closed fuel cut to the engine, and the cylinder is discriminated from the present rotational variation, so that the accuracy of cylinder discrimination can be enhanced sufficiently. Moreover, the fuel injection to the particular cylinder at the fuel cut time can be considered to be precedent to the return of combustion mode for each cylinder, so that the driving feeling is scarcely affected adversely. Further, if the intake air amount during fuel cut is increased in advance, the range in which combustion can be possible can be set so as to be wide, so that the rotational speed data of a predetermined sample can be obtained in a short period of time. If such consideration is given, the cylinder discrimination can be completed in a short period of time. In particular, the fuel cut time continues over a relatively long time, and therefore, if the detection of rotational variation is repeatedly executed, for example, using this period, the reliability of cylinder discrimination can easily be statistically increased. That is, the period for giving rotational variation is set long equivalently, by which the reliability of cylinder discrimination can be enhanced.

Like the aforementioned case of first cylinder discrimination, since the evaluation value $R_{1x(n)}$ is determined as a negative value in the cylinder of deteriorated combustion (misfire), and as a positive value in the combustion cylinder, the judgment level can be defined as zero [0]. Therefore, no complicated matching operation etc. are needed, and the cylinder discrimination based on the rotational variation can be reliably executed. Also, as described above, by interrupting cylinder discrimination at a speed change time, the erroneous judgment factors of rotational vibration resulting from speed change are eliminated, so that a possibility that the internal combustion engine is operated over a long period of time while the erroneous judgment result is kept can be prevented.

Assuming that as shown in the procedure in the above embodiment, the first cylinder discrimination is executed for a short period of time just after the start of engine, and the second cylinder discrimination is executed for a relatively long period of time at the subsequent fuel cut mode time, if, for example, the first cylinder discrimination fails, this failure can be compensated effectively by the subsequent second cylinder discrimination. Even when cylinder discrimination can be made by the first cylinder discrimination, the judgment result in the first cylinder discrimination can be reconfirmed by the subsequent second cylinder discrimination. If the judgment result in the first cylinder discrimination is erroneous, this error can be corrected reliably by the judgment result of the second cylinder discrimination. Therefore, reliable cylinder discrimination can be made in a short period of time just after the start by making the most of the advantages of the first and second cylinder discrimination, so that an effect that the transfer to sequential injection after cylinder discrimination can be facilitated is achieved.

The present invention is not limited to the above embodiment. For example, it is, needless to say, possible to configure the control unit so that only one of the aforementioned first and second cylinder discriminations is executed. When only the first cylinder discrimination is executed, the group injection mode should be set at the engine start, and it should be transferred to the sequential injection mode quickly at the time when cylinder discrimination is made. When only the second cylinder discrimination is executed, the all-cylinder simultaneous injection mode or the group injection mode should be set at the engine start, and it should be transferred to the sequential injection mode quickly at the time when the cylinder discrimination is made. Even when the aforesaid divided group injection shown in FIG. 6 is effected, the first and second cylinder discrimination can basically be executed in the same manner.

Although in the above embodiment, the description was made in connection with four-cylinder type internal combustion engine, in the case of three-cylinder type internal combustion engine, cylinder discrimination can be executed in the same manner by the method described below.

Figure 14:
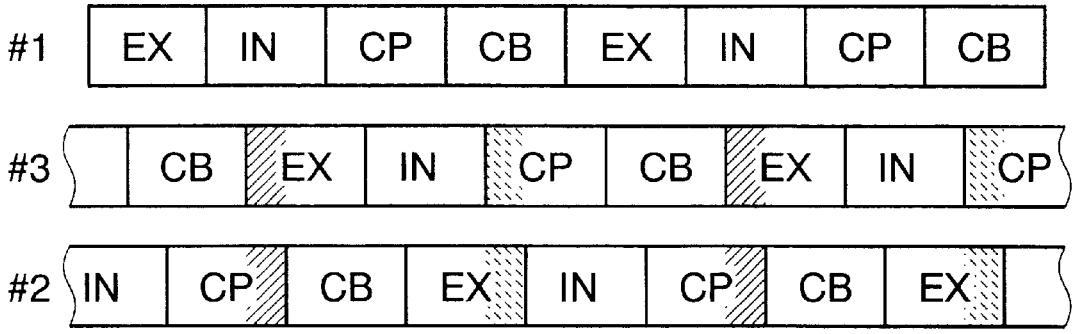
FIG. 14 is a view for illustrating the top position identification for a first cylinder in a three-cylinder type internal combustion engine.

In the case of three-cylinder type internal combustion engine, the combustion cycle for each cylinder is set at crank angle intervals of 240° in the order of the first, third, and second cylinders as shown in FIG. 14. Therefore, the apparatus is so configured that the reference pulses can be obtained for each 120° from the rotating member 1 (signal generating means) attached to the crankshaft, and an identification signal that can identify the first cylinder can be obtained from the rotating member 1 (identifying means). When the reference pulse indicative of the first cylinder is obtained from this signal generating means, fuel is injected simultaneously to the second and third cylinders assuming that the first cylinder is at the exhaust top position. The status of rotational variation at this time is detected, and it is determined whether the piston of the first cylinder is at the compression top position or at the exhaust top position by the same method as that for the aforementioned first and second cylinder discrimination.

Specifically, fuel is injected simultaneously to the -second and third cylinders as shown in FIG. 14 by the cross-hatching (solid and broken line) at a timing assuming that the first cylinder is at the exhaust top position, and the rotational variation between the reference pulse signals for the first cylinder is detected. It is necessary only that it is determined whether the above assumption is correct or not according to the rotational variation detected at this time, and it is determined whether the piston of the first cylinder is at the compression top position or at the exhaust top position from this determination result. In this case as well, like the above-described embodiment, determination is executed only when the conditions for executing a predetermined cylinder discrimination are met, by which the occurrence of unwanted engine stall should preferably be prevented. After the determination result is obtained, the mode should be transferred to the sequential injection mode quickly.

In the case of four-cylinder type internal combustion engine (even-numbered cylinders), explanation was given as to an example in which cylinder discrimination is made by making the injection amount of one cylinder (the first cylinder in the above embodiment) of the particular cylinder group (#1-4) having 360° different stroke phase from each other different from that of other cylinders. When the operation of this cylinder discrimination is considered, for example, by giving attention to the particular cylinder (for example, the first cylinder), the above-mentioned identification of the particular cylinder group substantially corresponds to the determination of whether the first cylinder is at the compression top position or at the exhaust top position. Thus, cylinder discrimination is made by making the injection amount of the particular cylinder different from that of other cylinders. It can therefore be said that the aforesaid cylinder discrimination in the case of even-numbered cylinders is based on the same concept as that of the cylinder discrimination for three-cylinder type internal combustion engine. Therefore, substantially, in the even-numbered cylinder type internal combustion engine, like the cylinder discrimination for three-cylinder type internal combustion engine, the 360° different stroke phases (for example, compression top and exhaust top) of the particular cylinder are identified, and the fuel injection amount for the particular cylinder is made different from that of other cylinders assuming that one of the stroke phases is positive, whereby the cylinders may be discriminated.

The cylinder discriminating apparatus of the present invention is not restricted by the number of cylinders of internal combustion engine. If the internal combustion engine has odd-numbered cylinders of three and more, the cylinder discrimination may be made by the above-mentioned method for cylinder discrimination for three-cylinder type internal combustion engine. Also, if the internal combustion engine has even-numbered cylinders of four and more, the cylinder discrimination may be made by the above-mentioned method for cylinder discrimination for four-cylinder type internal combustion engine.

Although the cylinder discrimination has been made immediately after the start of internal combustion engine or by detecting the fuel cut mode in vehicle deceleration in the above description, it also can be executed by detecting the state in which the vehicle is running at a constant speed. Specifically, the running of vehicle is started immediately after the start of internal combustion engine and the first cylinder discrimination cannot be made, and subsequently, when the vehicle transfers to the steady running mode, the second cylinder discrimination cannot be made quickly. That is, the cylinder discrimination result cannot be obtained, despite the fact that the steady running state is established, until the fuel cut mode by deceleration is detected, so that the simultaneous injection of all cylinders or the group injection at the start of internal combustion engine is continued.

Figure 15:
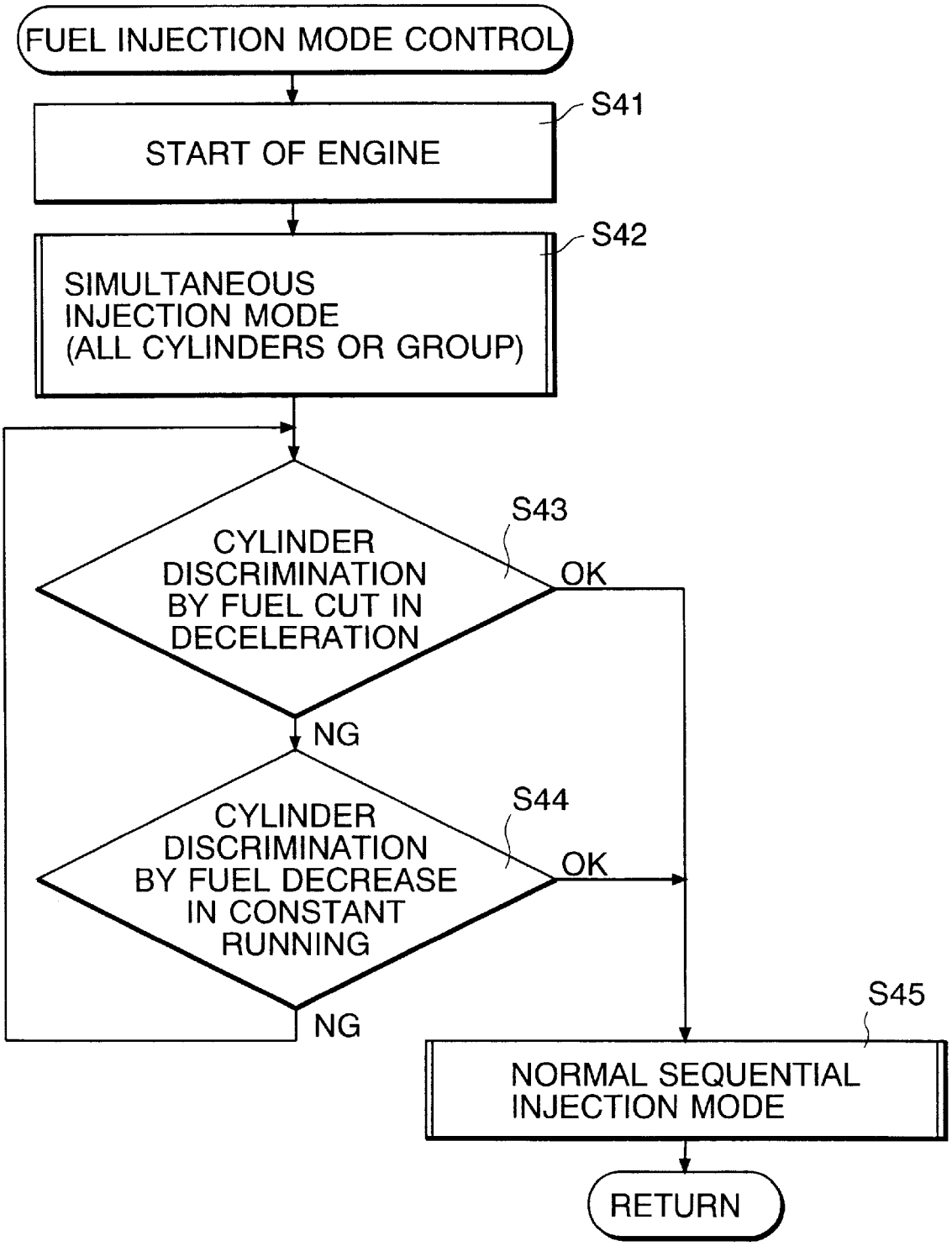
FIG. 15 is a flowchart showing a general procedure for fuel injection control when cylinder discrimination is adopted in a steady constant-speed running state.

Accordingly, in the present invention, as shown in the general control procedure of fuel injection mode of FIG. 15, even when the fuel cut mode by deceleration is not detected, the constant running state is detected and the rotational variation is given positively by making the fuel injection amount for the particular cylinder different from that for other cylinders, whereby the cylinder discrimination is executed.

Specifically, as shown in FIG. 15, after the engine is started (Step S41), the simultaneous injection mode is set for all cylinders or cylinder groups (Step S42). In this state, the fuel cut mode caused by deceleration is detected, and the aforesaid second cylinder discrimination is executed (Step S43). Alternatively, if the fuel cut mode is not detected, the steady constant-speed running mode of the vehicle (internal combustion engine) is detected by the steady running detecting means 22, and the third cylinder discrimination is executed (Step S44). This third cylinder discrimination is basically the same as the aforesaid first cylinder discrimination. It is executed by making the fuel injection amount for the particular cylinder (first cylinder) different from that for other cylinders by driving the first rotational variation imparting means 16.

The control system is configured so that when the cylinder discrimination result is obtained by the aforesaid second cylinder discrimination in the fuel cut mode, or when the cylinder discrimination result is obtained by the third cylinder discrimination in the steady constant-speed running mode, the normal sequential injection mode (Step S45) is executed according to the cylinder discrimination result.

Figure 16:
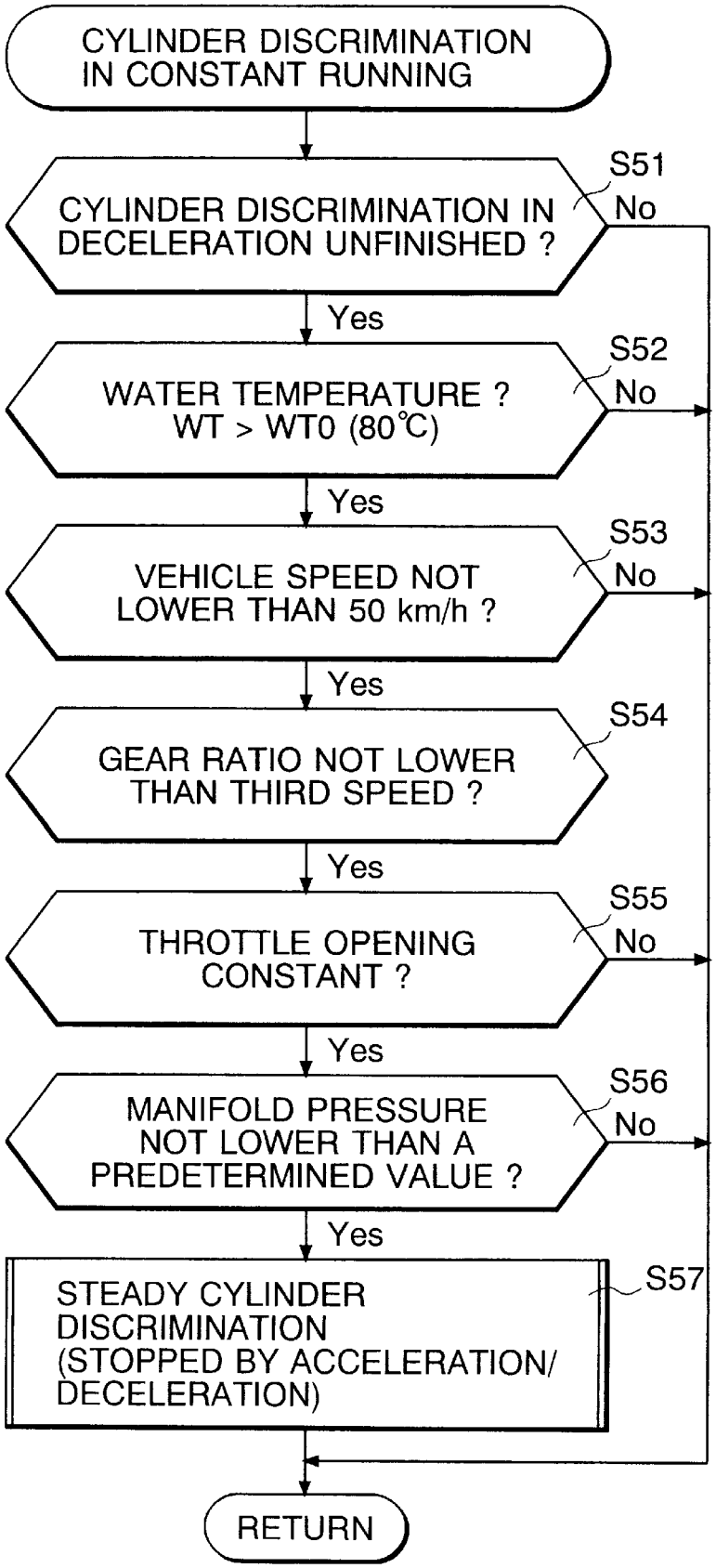
FIG. 16 is a flowchart showing a discrimination procedure for the execution conditions of cylinder discrimination in a steady constant-speed running state.

As shown in FIG. 16, the aforesaid third cylinder discrimination determines in sequence, on condition that the cylinder discrimination by the fuel cut mode in deceleration is not finished (Step S51), whether the water temperature of engine coolant is not lower than a predetermined temperature (for example, 80° C.) (Step S52), whether the vehicle speed is not lower than a predetermined value (for example, 50 km/h) (Step S53), whether the gear ratio is a predetermined high-speed ratio (for example, third gear) or higher (Step S54), whether the throttle opening is constant (Step S55), and whether the manifold pressure is not lower than a predetermined value (Step S56). If all of these conditions are met, the steady cylinder discrimination is executed (Step S57). That is to say, the steady cylinder discrimination is started on condition that the vehicle is in the ordinary running state, the throttle opening is kept constant with the accelerator not operated, and the manifold pressure does not change greatly (in other words, changes in a predetermined range).

If any one of the above conditions is not met, the steady cylinder discrimination is not executed, and even if the execution of steady cylinder discrimination is started, when the accelerator or brake is operated in the course of execution, the discrimination is stopped immediately. That is, only when the internal combustion engine is operated at a constant speed under certain conditions, the steady cylinder discrimination is made.

Figure 17:
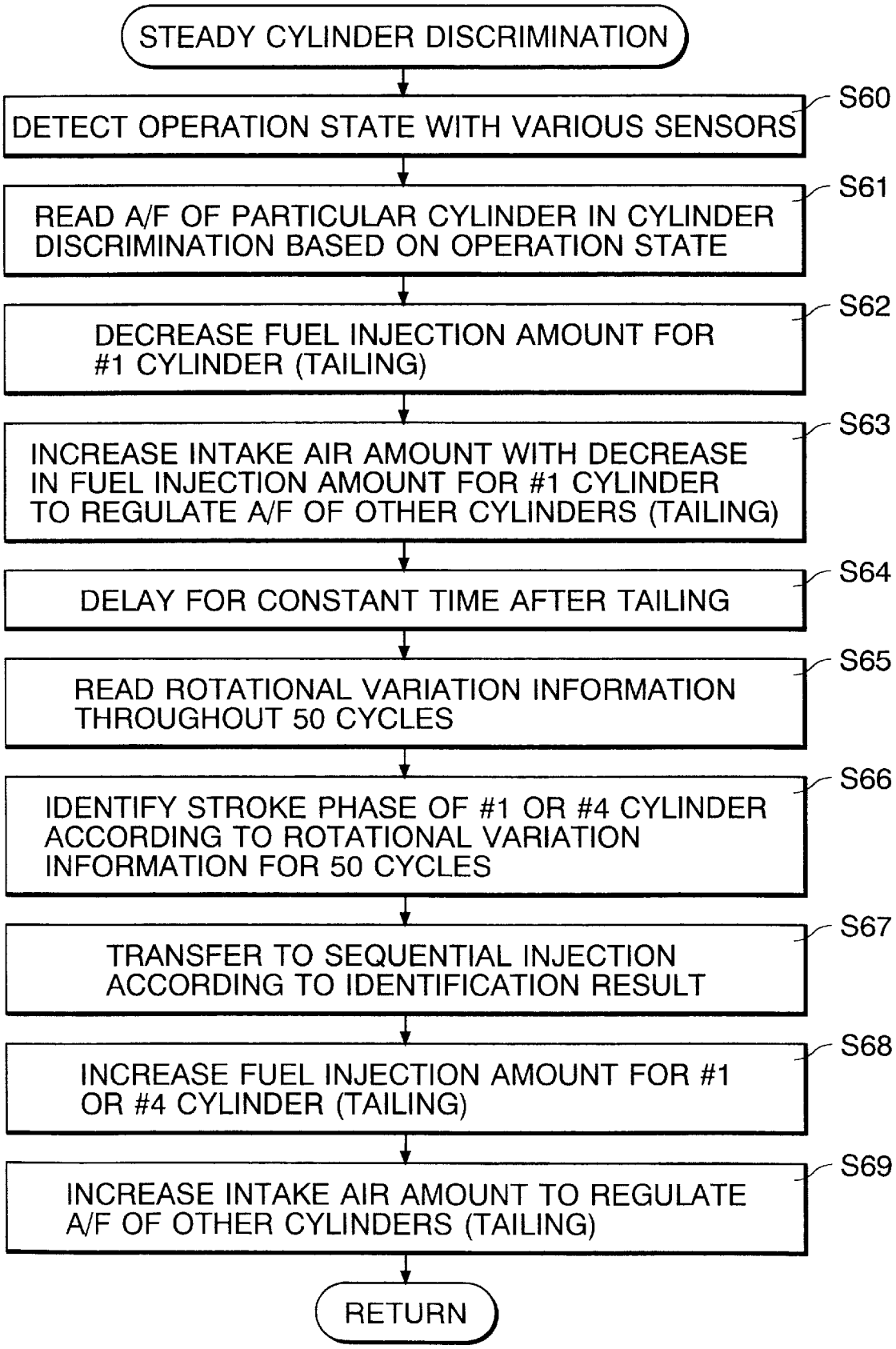
FIG. 17 is a flowchart showing one example of a schematic procedure for cylinder discrimination in a steady constant-speed running state.

This steady cylinder discrimination, as shown in an example of procedure of FIG. 17, is first started by detecting the operation state by means of various sensors mounted on the internal combustion engine and vehicle (Step S60). Based on the detected operation state, in starting the cylinder discrimination described below, the air-fuel ratio (A/F) of the particular cylinder is read from, for example, a data map set in advance (Step S61). In accordance with the detected air-fuel ratio, the fuel injection amount for the first cylinder, which is the particular cylinder, is decreased gradually to make it different from the fuel injection amount for other cylinders (Step S62).

Then, the intake air amount is increased to compensate the decrease in internal combustion engine output caused by the decrease in fuel injection amount for the first cylinder, and the air-fuel ratio (A/F) for other cylinders is regulated to keep the overall rotation output (specifically, torque) of internal combustion engine constant (Step S63). The intake air amount is increased by regulating the bypass passage area, for example, by increasing the opening degree of a bypass valve for bypassing the throttle valve.

After the control for decreasing the fuel injection amount for the first cylinder is carried out and the accompanying control of air-fuel ratio for other cylinders is carried out (tailing), a predetermined time elapse is allowed (Step S64), and the information about the rotational variation detected as described before is extracted throughout, for example, 50 combustion cycles (Step S65). It is determined throughout 50 cycles whether or not the rotational variation is caused by the decrease in fuel injection amount for the first cylinder, and it is determined whether the timing truly corresponds to the first cylinder or inversely corresponds to the fourth cylinder (Step S66). The algorithm for this determination is the same as that for the aforesaid first cylinder discrimination.

Subsequently, after the stroke phase of each cylinder is identified by determining the cylinder discrimination result as described above, the control transfers to the sequential injection mode in accordance with the cylinder discrimination result (Step S67). When the timing assumed as B5° reference truly corresponds to the first cylinder, this transfer to the sequential injection mode is carried out while gradually increasing the fuel amount to return the fuel injection amount for the first cylinder to the original fuel injection amount before the start of cylinder discrimination. Alternatively, when the assumption is wrong, and the timing assumed as B5° reference corresponds to the fourth cylinder, the transfer is carried out while gradually increasing the fuel injection amount for the fourth cylinder (Step S68). At this time, as the fuel injection amount for the first or fourth cylinder increases, the intake air amount regulated as described above is gradually returned to the original amount (Step S69). Since the rotation output increases as the fuel injection amount for the first or fourth cylinder is increased to return it to the original amount, in order to compensate it to keep the rotation output constant, the control transfers to the normal sequential injection mode while reducing the intake air amount and regulating the air-fuel ratio of other cylinders.

Thus, if the cylinder discriminating apparatus is configured so that the cylinder discrimination is executed by giving rotational variation positively even at the time of steady constant-speed running, even when the fuel cut state due to deceleration does not take place, the stroke phase of each cylinder can be identified effectively in the constant-speed running state in which the throttle opening is constant. Therefore, the control can transfer to the normal sequential injection mode quickly. Moreover, when the fuel injection amount for the particular cylinder is decreased, rotational variation is given while compensating the decrease in rotation output of internal combustion engine by increasing the intake air amount and regulating the air-fuel ratio for other cylinders, so that the deterioration in drivability due to torque variation is not caused. Therefore, together with the aforesaid cylinder discrimination at the time of fuel cut, an exact cylinder discrimination result can be obtained in a relatively short period of time after the engine start. Accordingly, a problem in that the internal combustion engine is unwillingly operated in the all-cylinder simultaneous injection mode, group injection mode, etc. for a long period of time caused by unidentified stroke phase of each cylinder is effectively prevented.

In the above embodiments, immediately after the rotational variation imparting means is operated, the rotational variation is detected. However, after the rotational variation imparting means is operated, the detection timing is delayed by several cycles (for example, two cycles), and when a rotational variation caused by receiving the influence of rotational variation impartment appears surely, the rotational variation is detected, by which the detection accuracy of rotational variation may be improved. In the embodiments, the calculated value $R_{1x(n-1)}$, which is an index for rotational variation, is determined for cylinder discrimination. However, for example, after the particular cylinder is discriminated, the pulse widths for every two strokes after the rotational variation impartment are accumulated alternately, and it may be determined whether the particular cylinder is compression top or exhaust top from the relationship of, for example, $$T_1+T_3+T_5+\ldots>T_2+T_4+T_6+\ldots$$

by the magnitude of pulse width.

In the above embodiments, explanation has been given assuming that the all-cylinder simultaneous injection or group injection is effected for the internal combustion engine for the period until the cylinder discrimination is completed, that is, for the period for which the cylinder is unidentified. However, from the viewpoint of combustion efficiency etc., the following injection mode may be set.

For four-cylinder internal combustion engines, the normal sequential injection timing of fuel for each cylinder is set as the exhaust (EX) stroke of each cylinder as indicated by the solid line cross hatching in the combustion cycle schematically shown in FIG. 18. More specifically, the fuel injection timing for each cylinder is set from the later half of the exhaust (EX) stroke to the early time of the succeeding intake (IN) stroke. However, if fuel is injected simultaneously at the timing as shown in FIGS. 5 to 7 for the period until the cylinder discrimination is completed, even if the fuel injection amount is increased by the accelerating operation (operation of accelerator) during that time, the increased fuel amount is not always immediately used for combustion. For example, even if acceleration is effected in the compression (CP) stroke of the first cylinder shown in FIG. 5, some delay occurs before the increase in fuel because the timing of group injection of fuel is the exhaust (EX) stroke, which is two strokes after the compression (CP) stroke.

In the present invention, therefore, as shown in FIGS. 19 and 20, an interim injection mode is set in which fuel is injected (solid cross-hatching) in sequence to each cylinder in the reverse order of the normal sequential injection mode. In this interim injection mode, while the ignition control for each cylinder is carried out in the same manner as the ordinary sequential injection mode, only the injection timing of fuel is set in the reverse order. Specifically, as shown in FIG. 19, fuel is injected in the exhaust (EX) stroke of the first and fourth cylinders so that the injection timing for the first and fourth cylinders is correct. Meanwhile, for the third and second cylinders, the injection timing is set so that fuel is wrongly injected in the compression (CP) stroke. Alternatively, as shown by the solid line cross-hatching in FIG. 20, for the first and fourth cylinders, fuel is injected in the compression (CP) stroke so that the injection timing is intently wrong, and inversely, for the third and second cylinders, the timing is set so that fuel is injected correctly in the exhaust (EX) stroke. It can be said that this is an abnormal sequential injection mode with respect to the normal sequential injection mode.

In either of the modes shown in FIGS. 19 and 20, in this interim injection mode, fuel is injected in the normal exhaust stroke for two cylinders having a 360° different stroke phase. The fuel injection for the remaining two cylinders is effected in the compression stroke.

According to this interim injection mode, even if accelerating operation is performed in the compression (CP) stroke of the first cylinder in the combustion cycle shown in FIG. 19, the fuel injection amount for the fourth cylinder entering the exhaust (EX) stroke is increased, so that the speed of internal combustion engine is rapidly increased. Also, even if accelerating operation is performed when the first cylinder is in the combustion (CB) stroke in the combustion cycle shown in FIG. 19, fuel can be increased at the fuel injection timing in the exhaust (EX) stroke after one stroke phase, so that the acceleration response can be ensured sufficiently. The acceleration response can be enhanced in the interim injection mode as compared with the case where conventional all-cylinder simultaneous injection or group injection is carried out.

When the interim injection mode is set at the timing shown in FIG. 20 as well, the correct injection timing is set for the remaining two cylinders as described above, so that the increase in speed of internal combustion engine can be achieved due to the rapid increase in fuel injection amount in response to the accelerating operation like the case of interim injection timing shown in FIG. 19.

Figure 21:
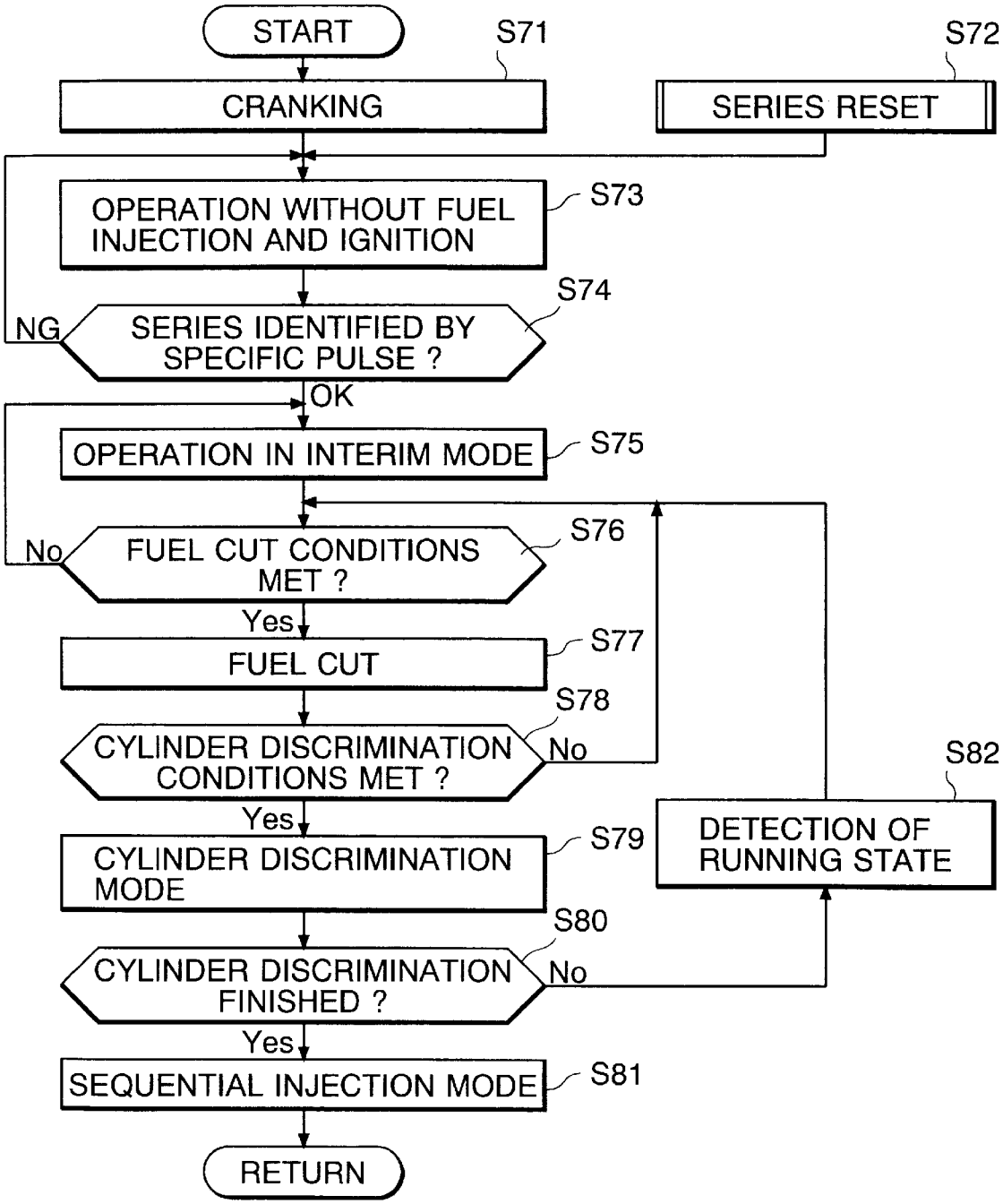
FIG. 21 is a flowchart showing a general control procedure for fuel injection control in an internal combustion engine when a fuel interim injection mode is adopted.

When the interim injection mode is employed, therefore, the fuel injection for the internal combustion engine should be controlled by following the procedure shown in FIG. 21, for example. Specifically, when the cranking of internal combustion engine is started by the activation of a starter switch as shown in FIG. 21 (Step S71), or when the series data of cylinder discrimination result determined already is reset for any reason (Step S72), the internal combustion engine is operated in a state in which fuel is not injected to the internal combustion engine, or in a state in which ignition is not effected (Step S73). At this time, in accordance with the aforesaid specific pulse in the series of the pulse signals obtained from the rotating member (signal generating means) 1 mounted on the crankshaft, which is the output rotating shaft, the pulse signal for the particular cylinder or the particular cylinder group consisting of two cylinders having different a 360° stroke phase is identified, and the pulse signal series is identified (Step S74).

After the pulse signal series is identified by this operation, the internal combustion engine is operated in the aforesaid interim injection mode in accordance with the timing of pulse signal corresponding to the first and fourth cylinders (#1-4), for example (StepS75). After the operation of internal combustion engine is started in the interim injection mode, it is determined whether or not the fuel full closed conditions, for example, due to deceleration are met (Step S76). If the fuel full closed conditions are met, fuel cut operation is executed to stop the injection of fuel to each cylinder (Step S77). In this state, it is determined whether or not the aforesaid second cylinder discrimination can be executed (Step S78). This discrimination is made by checking that the throttle opening is [0] and fuel injection is stopped to each cylinder under the condition that the rotational speed of internal combustion engine is not lower than a predetermined value. If the cylinder discrimination conditions are met, the cylinder discrimination mode executed as described above is set, and cylinder discrimination is made (Step S79).

If the stroke phase of each cylinder is identified by the cylinder discrimination, and the cylinder discrimination is finished (Step S80), the control transfers to the sequential injection mode in accordance with the cylinder discrimination result (Step S81). However, if the cylinder discrimination result is not identified, or if the acceleration or deceleration of internal combustion engine is effected in the course of the cylinder discrimination and the cylinder discrimination is stopped, the procedure from Step S76 is repeatedly executed again while detecting the running state (Step S82).

According to this procedure, until the stroke phase of each cylinder is exactly identified by cylinder discrimination, that is, until the cylinder discrimination is made, the fuel injection for the internal combustion engine can be controlled in accordance with the interim injection mode, so that even if acceleration or deceleration operation is performed by the operation of accelerator or brake during this time, the operation of internal combustion engine can be controlled efficiently by following this. Therefore, even if the cylinder discrimination is not completed, the drivability can be ensured sufficiently. Also, while the fuel injection mode for the internal combustion engine is controlled in the interim injection mode that can follow the driving operation, the fuel injection mode for the particular cylinder is made different from that of other cylinders, by which the cylinder discrimination can be made efficiently, and the control can transfer to the sequential injection mode quickly.

Although the case in which the interim injection mode is applied to the second cylinder discrimination was explained in FIG. 21, the interim injection mode may, needless to say, be applied to the case in which the cylinder discrimination is not executed by determining the fuel cut conditions in deceleration, but the cylinder discrimination is executed by detecting the aforesaid steady constant-speed running state. Needless to say, it may be applied to the case in which the cylinder discrimination is executed in accordance with the detection state while monitoring both of the fuel cut state and the steady constant-speed running state.

In the above-mentioned first and second cylinder discrimination, when the fuel injection amount for the particular cylinder was made different from that of other cylinders, the total output of internal combustion engine was kept constant by increasing the intake air amount and by regulating the air-fuel ratio for other cylinders. When a significant output variation in the internal combustion engine is restrained by regulating the controlled variable relating to the rotational speed of internal combustion engine and by keeping the rotational speed at a constant value or more, the intake air amount etc. may be adjusted and controlled in accordance with the tables configured as shown in FIGS. 22A and 22B.

Specifically, when a rotational variation is given by injecting fuel to the particular cylinder only in the aforesaid fuel cut mode, the throttle opening is close to the fully closed state and the intake air amount is very small, so that there is a possibility that the combustion due to fuel injection and the increase in rotational speed are not expected. In this case, therefore, for example, the intake air amount is increased to make the combustion of the particular cylinder normal and the output is increased, by which the detection accuracy should be enhanced.

In such a case, a table showing the lower limit flow rate of idle intake air amount set in accordance with the rotational speed of internal combustion engine, for example, as shown in FIG. 22A should be used to clip control the lower limit value. Further, a correction factor set in accordance with the cooling water temperature of internal combustion engine as shown in FIG. 22B should be used to correct the idle intake air amount. At this time, in order to regulate the idle intake air amount with good response, it is preferable to use a linear solenoid type control valve.

Thus, not only the idle intake air amount is lower-limit clip controlled in accordance with the rotational speed of internal combustion engine, but also the idle intake air amount is corrected in accordance with the engine water temperature, by which the aforesaid cylinder discrimination can be executed effectively while easily preventing the unwilling stop of internal combustion engine. Specifically, by multiplying the idle intake air amount determined in accordance with the rotational speed by a correction factor determined in accordance with the engine water temperature, a proper rotational variation in cylinder discrimination should be obtained, and an optimum idle intake air amount that can obtain good deceleration feeling should be determined. At this time, if the correction value of inherent idle intake air amount of internal combustion engine is determined as a learning value for idle intake air amount of internal combustion engine, for example, at the fuel cut time, and the intake air amount in cylinder discrimination is further corrected by using the correction value (learning value), the variations regarding the individuality of internal combustion engine are corrected, so that better control can be carried out.

If the cylinder discrimination cannot be made at the start of internal combustion engine, the fuel cut mode in deceleration or the steady constant-speed state is detected as described before, and the cylinder discrimination is executed. Before the completion of cylinder discrimination, fuel injection is controlled in accordance the all-cylinder simultaneous injection or group injection as described above or the abnormal sequential injection mode described in FIGS. 19 and 20. After the completion of cylinder discrimination, fuel injection is controlled in the normal sequential injection mode in accordance with the cylinder discrimination result.

However, the acceleration and deceleration of internal combustion engine is effected despite whether or not the cylinder discrimination is completed. Also, the degree of acceleration and deceleration is varied. The fuel control of internal combustion engine, which governs the acceleration and deceleration, is usually executed on the assumption that the internal combustion engine is operated in the normal sequential injection mode based on the cylinder discrimination result. However, the fuel injection timing naturally differs between the time when the cylinder discrimination has been completed at which the sequential injection mode is executed and the time when the cylinder discrimination is not yet completed, so that it is thought that the fuel control mode in the sequential injection mode used as it is presents a problem.

Specifically, the fuel injection timing differs when the cylinder discrimination is not yet completed, and for example, fuel is injected in the compression or combustion stroke, so that there arises a problem in that the sticking amount of the fuel to the intake port wall surface varies and the like problems. Further, a difference in calculation value of fuel amount to be injected is prone to be caused by the difference in injection timing. Such a fuel control error appears as a cause for deterioration in transient response to acceleration or deceleration or an excessive reaction, resulting in impaired drivability.

Accordingly, in the present invention, the transient correction fuel control data used for fuel control in acceleration and deceleration is set separately at a time when the cylinder discrimination has been completed and the at a time when the cylinder discrimination is not yet completed, and the transient correction fuel control data is used selectively in accordance with the fuel injection mode of internal combustion engine. The transient correction fuel control data set separately include a water temperature correction factor, rotational speed correction factor, acceleration tailing factor, etc. which are transient correction data regarding the acceleration increase amount of fuel in acceleration. These correction factors etc. should be given as the map information with the rotational speed of internal combustion engine and engine water temperature being parameters as shown in FIGS. 23A, 23B, and 23C.

Similarly, the transient correction data regarding the deceleration decrease amount of fuel in deceleration include a water temperature correction factor, rotational correction factor, pressure correction factor, deceleration tailing factor, etc. These factors should be set separately as the map information with engine water temperature and rotational speed, and manifold pressure being parameters.

When the fuel injection amount is increased by asynchronously increasing the fuel injection pulse in accordance with the throttle opening in acceleration when the cylinder discrimination is not yet completed, the fuel injection amount varies greatly in accordance with the number of injection pulses. Therefore, for example, as shown in FIGS. 25A, 25B, and 25C, a water temperature correction factor, rotational speed correction factor, and base fuel injection amount per one injection pulse should be set separately as the map information with the engine water temperature and rotational speed, and throttle opening being parameters.

If the transient correction fuel control data (correction factor etc.) for fuel control when the cylinder discrimination is not yet completed are set in this manner separately from the transient correction fuel control data used in the normal sequential injection mode, the control of fuel injection amount can be carried out in accordance with the fuel injection mode when the cylinder discrimination is not yet completed, so that the transient response to acceleration and deceleration is made good, and the drivability can be stabilized. In particular, at the injection timing in accordance with the fuel injection mode when the cylinder discrimination is not yet completed, a proper fuel amount according to acceleration or deceleration can be injected, so that smooth acceleration and deceleration control can be executed favorably as compared with the case where the normal sequential injection control is carried out.

INDUSTRIAL APPLICABILITY

As described above, according to the cylinder discriminating apparatus for an internal combustion engine in accordance with the present invention, a signal corresponding to each cylinder or each cylinder group with a 360° different stroke phase is obtained from the signal generating means mounted on the output rotating shaft of internal combustion engine, and an identification signal capable of identifying the single particular cylinder or the particular cylinders with a 360° different stroke phase is obtained, so that the stroke phase of a particular cylinder or a particular cylinder group that can be used as the reference for cylinder discrimination with correct timing can be identified.

After the cranking of internal combustion engine is completed, or in the fuel cut mode, or when the steady constant-speed running state is detected, the fuel injection amount for the particular cylinder or the particular cylinder group is made different from the fuel injection amount of other cylinders to positively produce a rotational variation in the internal combustion engine, and the stroke phase of each cylinder is discriminated in accordance with the present rotational variation and the cylinder group identification result, so that a particular cylinder (cylinder group) can be accurately discriminated in a short period of time without causing complete misfire.

When the amount of fuel injection for a particular cylinder or the particular cylinder group is made different from the fuel injection amount of the other cylinders to produce a rotational variation, the controlled variable relating to the rotational speed of internal combustion engine is regulated to keep the rotational speed at a predetermined speed or higher, so that an accident such as engine stall in cylinder discrimination can be prevented, and large output variations of internal combustion engine can be effectively restrained effectively. Moreover, the cylinder discrimination can be made without the deterioration in driving feeling, and the reliability of cylinder discrimination can be increased.

We claim:

1. A cylinder discriminating apparatus for an internal combustion engine provided in a multiple cylinder type internal combustion engine provided with a plurality of cylinders having one combustion stroke per two turns of a crankshaft and entering the combustion stroke in sequence at equal intervals, comprising:

cranking detecting means for detecting the cranking state of said internal combustion engine;

injection control means for controlling the actuation of a fuel injection valve provided in each of said cylinders;

rotational variation detecting means for detecting the rotational variation of said internal combustion engine;

identifying means for generating a signal for identifying a particular cylinder of said internal combustion engine;

cylinder discriminating means for discriminating the stroke phase of said cylinder in said internal combustion engine in accordance with the output of said identifying means and said rotational variation detection means;

said identifying means being configured as a sensing member which is provided on an output rotating shaft of said internal combustion engine and generates a signal corresponding to each cylinder of said internal combustion engine or each cylinder group having a 360° different stroke phase and an identification signal for identifying a single particular cylinder or two particular cylinders having a 360° different stroke phase in synchronization with the rotation of said output rotating shaft;

rotational variation imparting means for producing a rotational variation to said internal combustion engine by controlling the operation of said injection control means when the cranking of said internal combustion engine is detected by said cranking detecting means during starting of the engine;

said rotational variation imparting means stopping the operation of said fuel injection valve for said single particular cylinder or said particular cylinder together with a cylinder entering the combustion stroke continuously with this particular cylinder, or making the fuel injection amount from said fuel injection valve to these cylinders different from the fuel injection amount from said fuel injection valve to other cylinders when said internal combustion engine has odd-numbered cylinders, and stopping the operation of said fuel injection valve for either one of the two particular cylinders having said 360° different stroke phase or either one of said two particular cylinders together with a cylinder entering the combustion stroke continuously with this cylinder, or making the fuel injection amount from said fuel injection valve to these cylinders different from the fuel injection amount from said fuel injection valve to other cylinders when said internal combustion engine has even-numbered cylinders, whereby reliability of discrimination can be enhanced and the time taken therefor can be shortened.

2. A cylinder discriminating apparatus for an internal combustion engine according to claim 1, further comprising:

controlled variable regulating means for regulating a controlled variable relating to the rotational speed of said internal combustion engine following the starting of the engine to keep said rotational speed at a predetermined speed or higher when said rotational variation imparting means is operated, whereby stalling of the engine is prevented during cylinder discrimination.

3. A cylinder discriminating apparatus for an internal combustion engine according to claim 1 wherein said rotational variation imparting means additionally produces rotational variation in response to actuation of at least one fuel injection valve during a fuel cut mode for effecting cylinder discrimination.

4. A cylinder discriminating apparatus for an internal combustion engine according to claim 3 wherein said fuel cut mode can be generated both during deceleration and at constant engine speed.

5. A cylinder discriminating apparatus for an internal combustion engine provided in a multiple cylinder type internal combustion engine provided with a plurality of cylinders having one combustion stroke per two turns of a crankshaft and entering the combustion stroke in sequence at equal intervals, comprising:

injection control means for controlling the actuation of a fuel injection valve provided in each of said cylinders;

rotational variation detecting means for detecting the rotational variation of said internal combustion engine;

identifying means for generating a signal for identifying the particular cylinder of said internal combustion engine;

cylinder discriminating means for discriminating the stroke phase of a cylinder in said internal combustion engine in accordance with the output of said identifying means and said rotational variation detecting means;

said identifying means being configured as a sensing member which is provided on a rotating output shaft of said internal combustion engine and generates a signal corresponding to each cylinder or each cylinder group with a 360° different stroke phase of said internal combustion engine and an identification signal for identifying the single particular cylinder or the two particular cylinders with a 360° different stroke phase in synchronization with the rotation of said rotating output shaft;

fuel cut judging means for determining a fuel cut zone in vehicle deceleration where fuel injection is cut by said injection control means; and rotational variation imparting means for giving a rotational variation to said internal combustion engine by controlling the operation of said injection control means when said fuel cut zone is detected by said fuel cut judging means;

said rotational variation imparting means actuating said fuel injection valve for said single particular cylinder or said particular cylinder and a cylinder entering the combustion stroke continuously with this particular cylinder to inject fuel when said internal combustion engine has odd-numbered cylinders, and actuating said fuel injection valve for either one of the two particular cylinders with 360° different stroke phase or either one of said two particular cylinders and a cylinder entering the combustion stroke continuously with this cylinder to inject fuel when said internal combustion engine has even-numbered cylinders.

6. A cylinder discriminating apparatus for an internal combustion engine according to claim 5, further comprising speed change detecting means for detecting the speed change state of vehicle; and means for inhibiting or stopping cylinder discrimination made by said cylinder discriminating means when speed change is detected by said speed change detecting means.

7. A cylinder discriminating apparatus for an internal combustion engine provided in a multiple cylinder type internal combustion engine provided with a plurality of cylinders having one combustion stroke per two turns of a crankshaft and entering the combustion stroke in sequence at equal intervals, comprising:

cranking detecting means for detecting the cranking state of said internal combustion engine;

injection control means for controlling the actuation of a fuel injection valve provided in each of said cylinders;

rotational variation detecting means for detecting the rotational variation of said internal combustion engine;

identifying means for generating a signal for identifying a particular cylinder of said internal combustion engine;

cylinder discriminating means for discriminating the stroke phase of a cylinder in said internal combustion engine in accordance with the output of said identifying means and said rotational variation detecting means;

said identifying means being configured as a sensing member which is provided on a rotating output shaft of said internal combustion engine and generates a signal corresponding to each cylinder or each cylinder group having a 360° different stroke phase of said internal combustion engine and an identification signal for identifying a single particular cylinder or two particular cylinders having a 360° different stroke phase in synchronization with the rotation of said output rotating shaft;

fuel cut judging means for judging a fuel cut zone in vehicle deceleration where fuel injection is cut by said injection control means;

first rotational variation imparting means for producing a rotational variation to said internal combustion engine by controlling the operation of said injection control means when the cranking of said internal combustion engine is detected by said cranking detecting means; and second rotational variation imparting means for providing a rotational variation to said internal combustion engine by controlling the operation of said injection control means when said fuel cut zone is detected by said fuel cut judging means;

said first rotational variation imparting means stopping the operation of said fuel injection valve for said single particular cylinder or said particular cylinder together with a cylinder entering the combustion stroke continuously with this particular cylinder, or making the fuel injection amount from said fuel injection valve to these cylinders different from the fuel injection amount from said fuel injection valve to other cylinders when said internal combustion engine has odd-numbered cylinders, and stopping the operation of said fuel injection valve for either one of the two particular cylinders having a 360° different stroke phase or either one of said two particular cylinders together with a cylinder entering the combustion stroke continuously with this cylinder, or making the fuel injection amount from said fuel injection valve to these cylinders different from the fuel injection amount from said fuel injection valve to other cylinders when said internal combustion engine has even-numbered cylinders;

said second rotational variation imparting means actuating said fuel injection valve for said single particular cylinder or said particular cylinder and a cylinder entering the combustion stroke continuously with this particular cylinder to inject fuel when said internal combustion engine has odd-numbered cylinders, and actuating said fuel injection valve for either one of the two particular cylinders having a 360° different stroke phase or either one of said two particular cylinders together with a cylinder entering the combustion stroke continuously with this cylinder to inject fuel when said internal combustion engine has even-numbered cylinders;

said injection control means having means for controlling the fuel injection for each cylinder on the basis of the cylinder discrimination result determined by the operation of said first rotational variation imparting means during the time from when said internal combustion engine is started to when the cylinder discrimination result is determined by the operation of said second rotational variation imparting means, and controlling the fuel injection for each cylinder on the basis of the cylinder discrimination result determined by the operation of said second rotational variation imparting means after the cylinder discrimination result is determined by the operation of said second rotational variation imparting means.

8. A cylinder discriminating apparatus for an internal combustion engine provided in a multiple cylinder type internal combustion engine provided with a plurality of cylinders having one combustion stroke per two turns of a crankshaft and entering the combustion stroke in sequence at equal intervals, comprising:

steady running state detecting means for detecting the steady running state of said internal combustion engine;

injection control means for controlling the actuation of a fuel injection valve provided in each of said cylinders;

rotational variation detecting means for detecting the rotational variation of said internal combustion engine;

identifying means for generating a signal for identifying a particular cylinder of said internal combustion engine;

cylinder discriminating means for discriminating the stroke phase of said cylinder in said internal combustion engine in accordance with the output of said identifying means and said rotational variation detecting means;

said identifying means being configured as a sensing member which is provided on an rotating output shaft of said internal combustion engine and generates a signal corresponding to each cylinder or each cylinder group having a 360° different stroke phase of said internal combustion engine and an identification signal for identifying a single particular cylinder or two particular cylinders having said 360° different stroke phase in synchronization with the rotation of said output rotating shaft; and rotational variation imparting means for producing a rotational variation to said internal combustion engine by controlling the operation of said injection control means when the steady running state of said internal combustion engine is detected by said steady running state detecting means;

said rotational variation imparting means stopping the operation of said fuel injection valve for said single particular cylinder or said particular cylinder together with a cylinder entering the combustion stroke continuously with said particular cylinder, or making the fuel injection amount from said fuel injection valve to these cylinders different from the fuel injection amount from said fuel injection valve to other cylinders when said internal combustion engine has odd-numbered cylinders, and stopping the operation of said fuel injection valve for either one of said two particular cylinders having a 360° different stroke phase or either one of said two particular cylinders together with a cylinder entering the combustion stroke continuously with this cylinder, or making the fuel injection amount from said fuel injection valve to these cylinders different from the fuel injection amount from said fuel injection valve to other cylinders when said internal combustion engine has even-numbered cylinders; and controlled variable regulating means for regulating a controlled variable relating to the rotational speed of said internal combustion engine to keep said rotational speed at a predetermined speed or higher before said rotational variation imparting means is operated.

9. A cylinder discriminating apparatus for an internal combustion engine according to claim 8, wherein, when said multiple cylinder type internal combustion engine has even-numbered cylinders, said injection control means actuates the fuel injection valve for each cylinder in sequence in accordance with the output of a signal corresponding to each cylinder group from said identifying means before said rotational variation imparting means is operated and after an identification signal for identifying said particular cylinder is generated by said identifying means.

10. A cylinder discriminating apparatus for an internal combustion engine according to claim 9, wherein said injection control means has injection amount setting means responsive to transient correction information during acceleration and deceleration for setting the injection amount from said fuel injection valve, and the transient correction information by said injection amount setting means is set separately either at a time when the cylinder discrimination has been completed or the time when the cylinder discrimination is not yet completed.

11. A cylinder discriminating apparatus for an internal combustion engine according to claim 4 wherein said transient correction information during acceleration includes a water temperature correction factor, a rotational speed correction factor, and an acceleration tailing factor.

12. A cylinder discriminating apparatus for an internal combustion engine according to claim 11 wherein said transient correction information during deceleration includes a water temperature correction factor, a rotational correction factor, a pressure correction factor, and a deceleration tailing factor.

* * * * *